United States Patent [19]

Abraham

[11] 4,369,631

[45] * Jan. 25, 1983

[54] REFRIGERATED MERCHANDIZER DISPLAY CASE ADAPTED FOR ENERGY CONSERVATION

[75] Inventor: Fayez F. Abraham, Niles, Mich.

[73] Assignee: Tyler Refrigeration Corporation, Niles, Mich.

[ * ] Notice: The portion of the term of this patent subsequent to May 5, 1998, has been disclaimed.

[21] Appl. No.: 141,359

[22] Filed: Apr. 18, 1980

Related U.S. Application Data

[63] Continuation-in-part of Ser. No. 101,069, Dec. 7, 1979, Pat. No. 4,265,090, which is a continuation-in-part of Ser. No. 25,473, Jun. 30, 1979, Pat. No. 4,245,482, and Ser. No. 58,916, Jul. 19, 1979, Pat. No. 4,242,882.

[51] Int. Cl.[3] ..... F25D 21/12; A47F 3/04

[52] U.S. Cl. ..... 62/82; 62/255; 62/256; 62/282

[58] Field of Search ..... 62/255, 256, 82, 282, 62/408, 151; 312/116, 236

[56] References Cited

U.S. PATENT DOCUMENTS

| | | | |
|---|---|---|---|
| 3,850,003 | 11/1974 | Beckwith et al. | 62/458 X |
| 3,937,033 | 2/1976 | Beckwith et al. | 62/234 X |
| 4,265,090 | 5/1981 | Ibrahim | 62/256 |

*Primary Examiner*—Lloyd L. King

*Attorney, Agent, or Firm*—LeBlanc, Nolan, Shur & Nies

[57] ABSTRACT

An improvement in open front refrigerated cabinets for food product storage and displaying in which transparent barrier doors and an air defrost system are provided for improving the energy efficiency. Barrier doors and an air defrost system can be retrofitted onto an open front refrigerated display case in order to permit operation of the cabinet with lower energy consumption. The air defrost system selectively creates a gap between the barrier doors and the associated access opening in order to provide for through-flow of ambient air during a defrost cycle. Open front cabinets having either single or multiple circulated air bands can be improved with this invention. The method of retrofitting such cabinets and the method of operations thereof is also included.

98 Claims, 19 Drawing Figures

Fig. 1
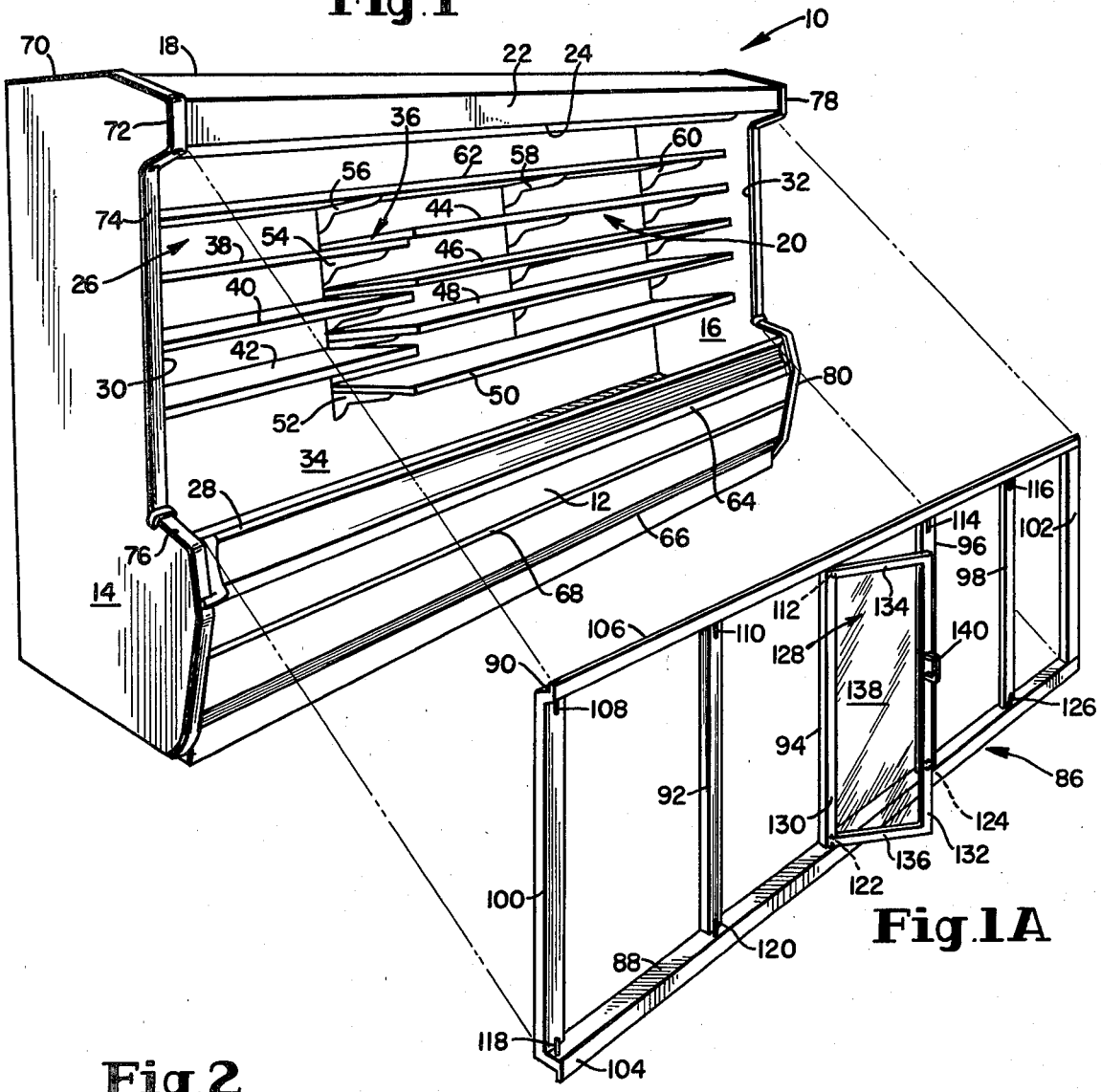
Fig. 1A
Fig. 2
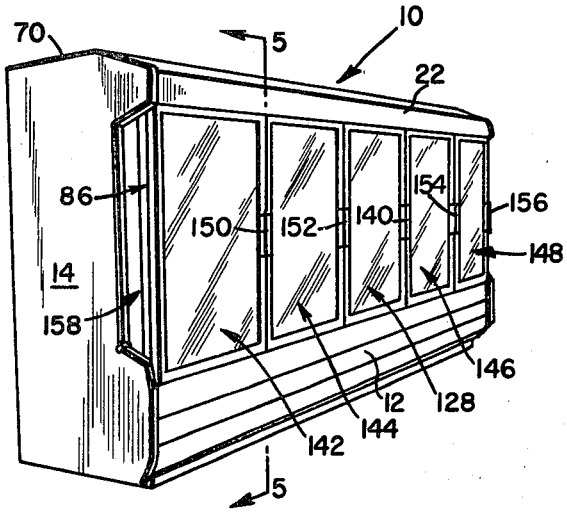
Fig. 3
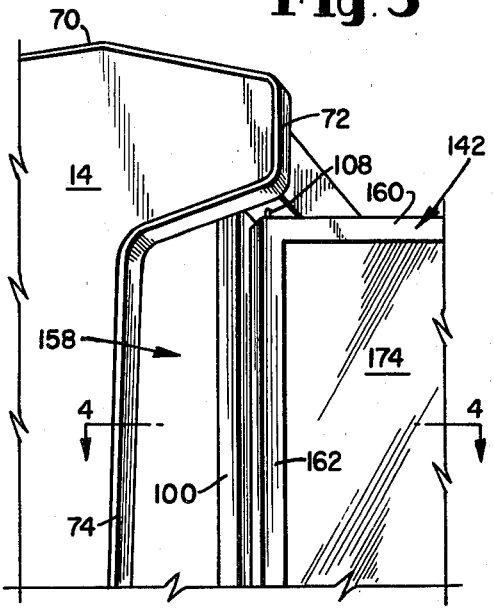

REFRIGERATED MERCHANDIZER DISPLAY CASE ADAPTED FOR ENERGY CONSERVATION

RELATED APPLICATIONS

The present application is a continuation-in-part of application Ser. No. 101,069, filed Dec. 7, 1979, now U.S. Pat. No. 4,265,090 which application is in turn a continuation-in-part of applications Ser. No. 25,473, filed June 30, 1979, now U.S. Pat. No. 4,245,482, and Ser. No. 58,916, filed July 19, 1979, now U.S. Pat. No. 4,242,882.

The present application is also related to the copending application Ser. No. 141,360 filed Apr. 18, 1980 and entitled REFRIGERATED MERCHANDISER DISPLAY CASE which has the same inventorship and assignee. The disclosures of all of these applications are hereby incorporated by reference as though fully set forth herein.

BACKGROUND OF THE INVENTION

The present invention relates to a "reach-in" merchandiser type of open front refrigerated display case of cabinet used primarily in retail food and supermarket outlets.

More particularly, it relates to a refrigerated display cabinet having an air defrost system incorporated therein in which transparent barrier doors are retrofitted onto the cabinet in a manner which does not interfer with the air defrost system and enhances the energy efficiency of the cabinet.

The term "refrigerated", in accordance with the present invention is intended to incorporate those cases maintained at a temperature at or in excess of 32° F., such as display cases utilized for the display of milk and fresh foods, and those cases maintained below 32° F., such as frozen food cases. In addition, references are made herein to the use of transparent doors with such open front cabinets, since those are the type of doors most frequently utilized in such retail outlets. Other types of doors could also be employed within the scope of the present invention.

In the operation of all types of refrigerated display cabinets, it is desirable to include a system for automatically defrosting the refrigeration coils. The defrost cycle can be actuated either at set periodic time intervals or when the frost buildup within the system has reached a certain predetermined level. Such systems are typically thermostatically controlled so as to switch from a refrigeration cycle to a defrost cycle of operation. In this manner of operation it is possible to avoid any significant frost buildup within the display cabinet such that inoperability and spoilage of food products would occur.

There have been three different approaches for defrosting refrigerated display cabinets in this art. These are, utilizing electric resistance heaters; passing a compressed refrigerant gas having a high specific heat through the refrigeration coils; and, circulating ambient air through an air conduit in which the refrigeration coils are positioned. Due to the increased cost of energy, efforts have been made to place more emphasis on the utilization of ambient air defrost systems as an alternative to the electrical resistant heaters or compressed refrigerant gas defrost systems.

One type of system which employs ambient air during a defrost cycle is exemplified by U.S. Pat. Nos. 3,403,525; 3,850,003 and 3,937,033, all to Beckwith et al.

These systems use fans separate and distinct from the main circulating fans to move ambient air across the refrigeration coils for defrosting. The additional fans are turned on only during the defrost cycle of operation for pulling ambient air from outside of the display cabinet directly into the air conduits located within the walls of the cabinet. A second type of system is illustrated in U.S. Pat. No. 3,082,612 to Beckwith, which system draws ambient air into the main circulation path through ports located in the lower front panel of the refrigerated display cabinet. Such ports are normally closed during the refrigeration cycle and opened during the defrost cycle. The Beckwith et al U.S. Pat. No. 3,850,003 indicates that the concepts described in U.S. Pat. Nos. 3,082,612 and 3,403,525 did not prove to be practical and hence were not commercially feasible.

Another type of ambient air defrost system is shown in U.S. Pat. No. 4,144,720 issued to Subera et al which is assigned to the same assignee as the present application. In the Subera patent, an open-front refrigerated display case having primary and secondary air conduits is disclosed. In this system the direction of the air flow within one of the conduits is reversed, for example, by the use of reversible fans to provide ambient air defrost. U.S. Pat. No. 4,026,121 to Aokage et al, which illustrates an open-front display case, and U.S. Pat. No. 4,120,174 to Johnston, which illustrates an open-top display case, also disclose reverse ambient air flows for defrosting.

In those ambient air defrost systems disclosed in the above-noted patents which use a reverse air flow, during the defrost cycle of operation, ambient air can easily be drawn through the access opening of the case or cabinet into the air conduit through the outlet opening located in the air conduit, and then expelled from the air conduit after the defrost operation through the inlet opening, and then forced out of the cabinet through the unblocked access opening. Such an arrangement, however, cannot be readily used in a refrigerated merchandiser display case having barrier doors, since the front opening in the cabinet is covered by the doors. Thus, in order to employ an ambient air defrost system, a different type of system had to be conceived.

In seeking to employ ambient air defrost techniques in cases having doors, systems have been developed for drawing air over a limited portion of the air conduit by opening flaps into the conduit, which flaps are arranged so as to straddle the evaporator coils of the refrigeration mechanism. Such systems are disclosed in U.S. Pat. No. 3,226,945 to Spencer and U.S. Pat. No. 4,072,488 to Johnston. The patent to Spencer illustrates a plurality of different embodiments of open-top refrigerated display cases, both of the single shelf and multi-shelf types, in which the air flow is always drawn over evaporator coils in a single direction under negative pressure. During the refrigeration cycle of operation, air after being refrigerated is circulated through the air conduit and into the display section of the case. The patent to Johnston discloses a glass door type merchandiser display cabinet in which air is circulated through the air conduit and through the evaporator coils arranged within the air conduit in such a direction that cold air enters the display space at the bottom of the cabinet and is then drawn up into the air inlet located near the top of the cabinet. For defrosting, top flaps are opened since this case is designed with coils at the top. This shows a somewhat complicated way to provide both glass doors and air defrost features according to the prior art. Such systems are relatively complex and can involve certain operational problems, particularly due to frost and dust accumulation. Where there are moving parts inside of the air conduit an accumulation of frost on such parts can cause them to stick and hence not function properly.

The prior art as represented by the patents discussed above has treated the opening of the barrier doors on such merchandiser refrigerated cabinets as being only a problem as illustrated by Johnston, U.S. Pat. No. 4,072,488 which describes the frost buildup due to the opening of the cabinet doors.

The prior art does not appear to have viewed the opening of the doors as a possible solution to the defrosting requirements.

The background of the invention described and claimed in the present application also includes a recognition of the energy conservation trend among managers of retail food outlets to reduce operating costs wherever possible. One such possibility for energy conservation is to provide heat transfer constraining barrier doors across the access opening of the refrigerated merchandiser display cabinet in order to reduce the contact between the ambient air which has high heat and moisture content and the refrigerated air within the display cabinet. Such barrier doors are often constructed of double or triple layer glass or other transparent materials, such as plastic sheets.

During periods of high door opening frequency for shopping or stocking the case or when the store ambient heat and humidity levels are elevated the refrigerated air band which may be at a temperature as low as −15° F. is contacted by ambient air having a temperature as high as 75° F. This contact can raise the refrigeration load even above that required by multi-air band open front cases having no barrier doors. To solve this problem it is optimum to employ one or two guard air bands which can protect the inner refrigerated band against direct contact with the ambient air when the merchandiser doors are opened.

Beckwith et al U.S. Pat. No. 3,403,525 also discloses a night curtain which is to be placed over the normally open access area of a refrigerated case in order to reduce energy consumption during the "non-sales" hours, but with this arrangement no air defrost or customer entry is possible.

Vogel, U.S. Pat. No. 4,117,698 discloses a retractable night curtain for use during closed store hours during which no provision is made for customer entry.

SUMMARY OF THE INVENTION

An improvement in open front refrigerated cases is disclosed for cases having one or more circulated air bands and an air defrost system. A barrier door is provided for installation across the access opening and an air defrost means is arranged to selectively create a gap between the barrier door and the associated access opening to effect refrigeration and defrost cycles of operation in a simple and low energy consumption manner. The barrier door and the air defrost means can be retrofitted to an existing refrigerated case which is already in service.

The air defrost means also includes an air moving means for passing ambient air through a cabinet and through the gap between the door and the access opening to bring the ambient air into contact with refrigeration elements in the cabinet to remove accumulated frost therefrom and to thereafter eject the defrost ambient air from the cabinet. The gap created between the barrier door and the access opening is thus part of the flow path of the ambient air being passed through the refrigerated cabinet to effect the defrosting function. The air moving means can be the fans in an existing display case when retrofitting is carried out.

The invention encompasses arranging such an air defrost means in association with the display cabinet to selectively create a gap between the barrier door and the access opening of a cabinet having only a single circulated, refrigerated air band propelled within an air conduit or having a plurality of circulated air bands therein of the type which are often used in food outlets without heat transfer constraining barrier doors. When a plurality of air bands are included in the cabinet the outermost of these will function as a guard band and can be operated only when needed due to expected or actual use conditions in the store.

It is, therefore, an object of the present invention to provide a barrier door and an improved ambient air defrost means for a refrigerated display cabinet of the open front type which has a customer access opening therein to provide for low energy consumption operation.

Another object of the present invention is to provide a refrigerated display cabinet having an air defrost system with a barrier door and an air defrost means which selectively creates a gap between a barrier door and the access opening covered by the door in order to provide for ambient air passage through the cabinet for defrosting purposes.

Still another object of the present invention is to provide a reach-in refrigerated merchandiser display cabinet or case with an improved ambient air defrost system.

Yet another object of the present invention is to provide a glass door merchandiser refrigerated display cabinet with an improved ambient air defrost system wherein during the defrost operation ambient air is drawn into the cabinet and circulated through at least a substantial portion of the primary refrigerated air conduit and is thereafter expelled from the cabinet by utilizing an air flow path which passes through a gap created between an installed barrier door and an access opening which is covered by the door.

Specific preferred embodiments of the invention will be described below with reference to the appended drawing figures.

BRIEF DESCRIPTION OF THE DRAWINGS

FIG. 1 is a schematic perspective view of an open front reach-in merchandiser refrigerated display case of the type which can be improved according to the present invention;

FIG. 1A is a schematic perspective view of a door frame having provision for barrier doors therein which can be retrofitted into the display case of FIG. 1;

FIG. 2 is a schematic perspective view of a reach-in merchandiser refrigerated display case having a retrofitted door frame and barrier doors installed therein;

FIG. 3 is a schematic perspective view of the left front top corner of the refrigerated display case illustrated in FIG. 2 showing one of the barrier doors in an open position adjacent to a vertical end frame member of the installed door frame;

DESCRIPTION OF THE PREFERRED EMBODIMENTS

Figure 6:
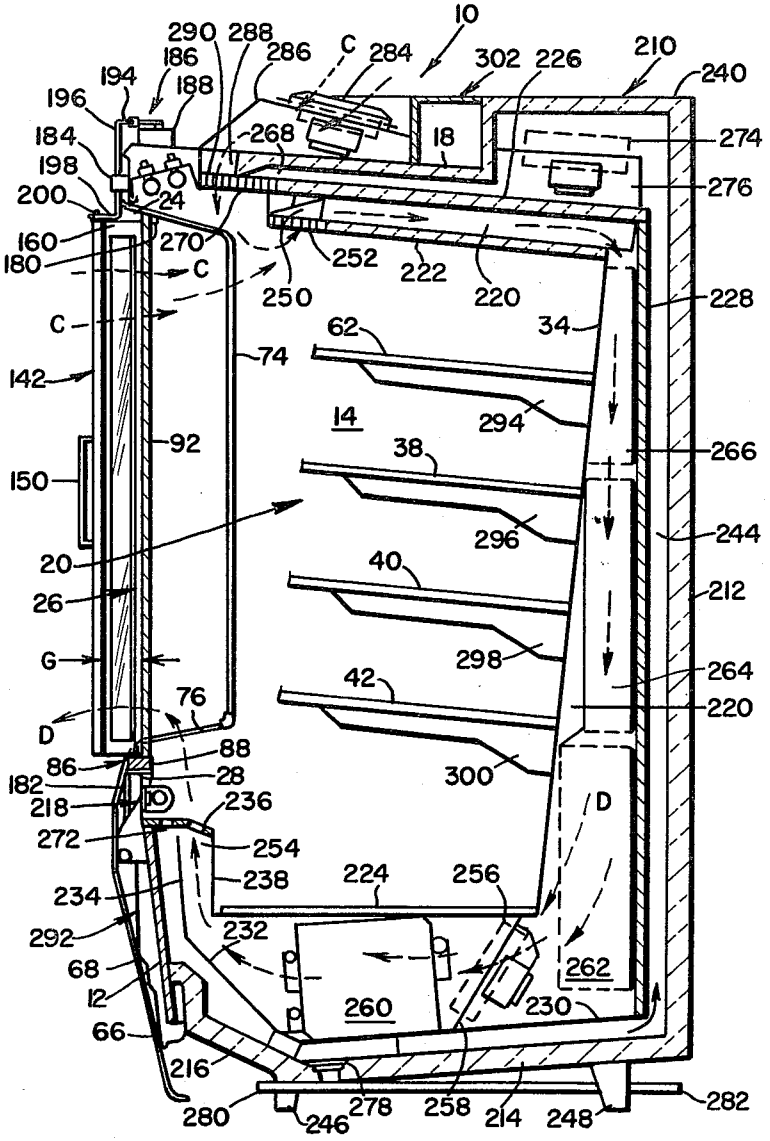
FIG. 6 is a schematic cross-sectional view of the refrigerated display case illustrated in FIG. 5 when such display case is operated during a defrost cycle.

Referring to FIGS. 1–9, an open-front refrigerated merchandiser cabinet 10 is illustrated in FIG. 1 as having a front wall 12, end walls 14 and 16, top wall 18 and a rear wall (shown in FIG. 5) to form a refrigerated display space 20. The front portion of top wall 18 is connected to a display hood 22 which forms the upper edge portion 24 of access opening 26. The lower edge portion 28 of the display cabinet structure forming access opening 26 is the top most portion of front wall 12. Side edge portions 30 and 32 in end walls 14 and 16, respectively, also define the vertical edges of access opening 26. Inside of cabinet 10 rear display panel 34 defines the interior plane of the display space 20. A series of shelves 36 are attached to rear display panel 34 for displaying products contained within merchandiser cabinet 10. The shelves can be arranged at different heights, as shown by the short-length shelves 38, 40 and 42 located in the left portion of display space 20, with respect to other shelves 44, 46, 48 and 50 arranged in the right portion of display space 20. Shelf brackets 52, 54, 56, 58 and 60 are provided for the various shelves including top shelf 62.

Front wall 12 also has provided on its outer surface an upper bumper rail 64 and a lower bumper rail 66. Various trim members usually constructed of chrome strips or colored plastic strips are provided for decoration of display cabinet 10. A trim panel member 68 is shown in front panel 12, and end wall 14 is provided with a top trim strip 70 which has a front hood trim portion 72 and vertical portions 74 connected to lower trim strip portions 76. Similar end panel trim strips 78 and 80 are provided for opposite end panel 16.

FIG. 1A shows a door frame 86 which can be retrofitted into display cabinet 10 between upper edge portion 24 and lower edge portion 28 in order to substantially cover the open front area of access opening 26. The door frame 86 is constructed of a lower frame member 88, an upper frame member 90 which are positioned in horizontal parallel relationship and connected by a series of frame mullions 92, 94, 96, and 98 and by end channel members 100 and 102. Lower frame member 88 is provided with a downwardly extending lip 104 which can be integrally formed with the lower frame member or provided as a separate lip member underlying the lower frame member. A similar upper lip 106 is provided for upper frame member 90. Upper hinge pins 108–116 are shown depending from upper frame member 90 to which they are integrally affixed near mullions 92–98 and end channel member 100. Lower aligned hinge pins 118–126 are also affixed to the upper portion of lower frame member 88. Barrier doors such as illustrated by barrier door 128 are installed between opposite upper and lower hinge pins, such as illustrated by upper hinge pin 112 and lower hinge pin 122 for barrier door 128. Barrier door 128 is constructed of two substantially parallel door frame members 130 and 132 and upper and lower door frame members 134 and 136 for supporting a single or multiple glass panes illustrated as pane 138. A handle 140 is connected to frame member 132 on the openable side of the door. Barrier doors similar to door 128 can be provided for each of the open spaces at either side of the mullions 92, 94, 96 and 98 in order to substantially cover the front open area of access opening 26.

Door frame 86 when installed in display cabinet 10 is shown in FIG. 2 wherein doors 142, 144, 146 and 148 are provided in the manner described immediately above and are also equipped with handles 150, 152, 154 and 156. The doors can also be slidably mounted in a suitable door frame, if desired. As shown by the interfitting of door frame 86 into access opening 26 of display cabinet 10 side openings 158 remain due to the C-configuration of end panels 14 and 16.

The door frame and barrier doors construction can be similar to that described in U.S. Pat. No. 3,331,159 to Cooke et al which is assigned to the assignee of the present application.

Figure 4:
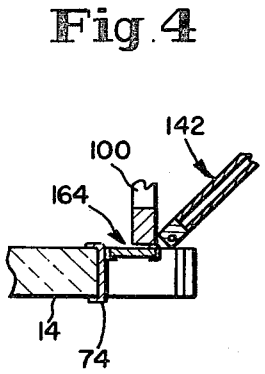
FIG. 4 is a schematic cross-sectional view of the end portion of the display case illustrated in FIG. 3 taken on line 4—4 showing an end adapter member for fitting the door frame into the display cabinet.
Figure 4A:
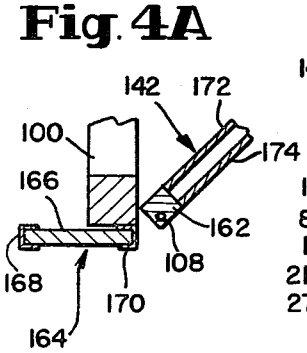
FIG. 4A is an enlarged schematic cross-sectional view of the side adapter member and associated display cabinet parts illustrated in FIG. 4.

Referring to FIGS. 3-4A, side opening 158 is shown as defined by trim strips 72 and 74 of end wall 14 and end vertical channel member 100 of door frame 86. Also shown, in an open position, is door 142 having upper hinge pin 108 visible above the top frame member 160. The vertical door frame member 162 is shown adjacent to end frame channel member 100. The opening 158 is closed by installation of a side adapter member 164 which is affixed to display case 10 between the end wall trim strip 74 and side frame channel member 100 as shown in FIGS. 4 and 4A. Side adapter 164 is constructed of one or more plastic or metal panel(s) 166 to which are fitted U-shaped channel members 168 and 170 which can be pop-riveted to the adjoining parts of the display case 10. In general, it is not necessary for the side adapter members to fit in an airtight manner, rather it is sufficient if the side adapter members 164 prevent intermixing of the ambient air with the refrigerated air band or bands inside of display cabinet 10 in a substantial manner. Door 142 is shown in FIGS. 4 and 4A as being constructed of two glass panels 172 and 174.

Figure 5:
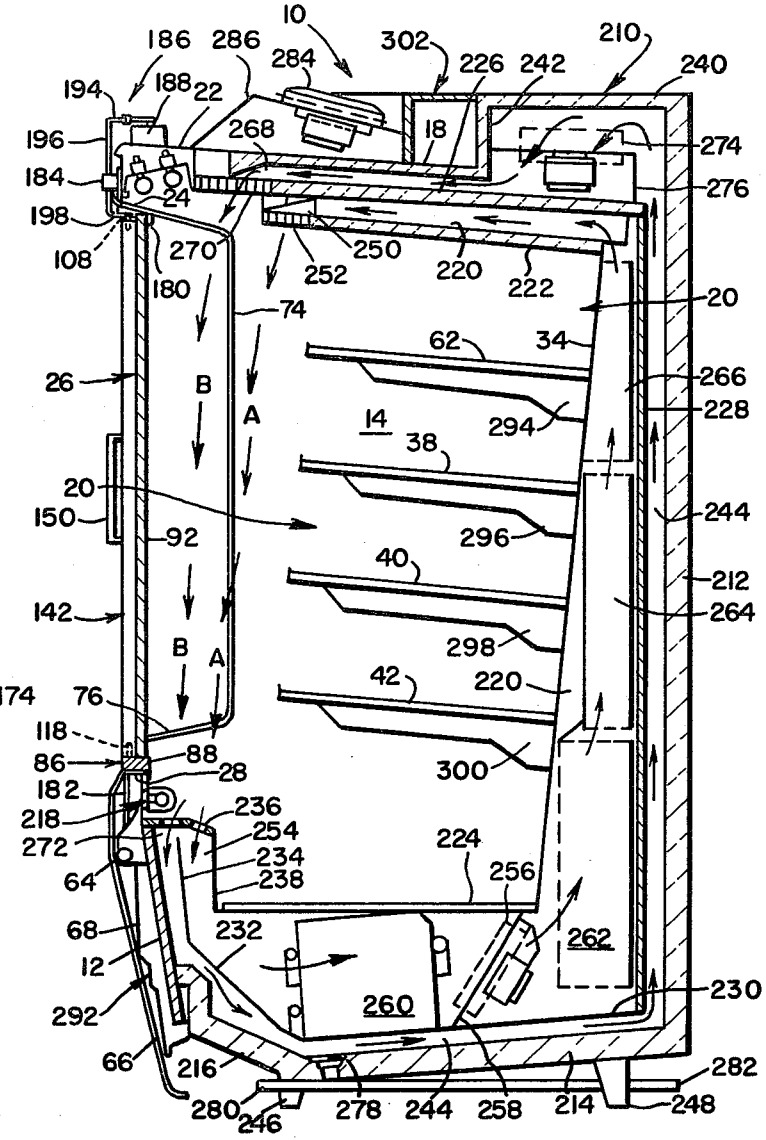
FIG. 5 is a schematic cross-sectional view of the refrigerated display case illustrated in FIG. 2 taken on line 5—5 after such display case has been fully retrofitted and when it is operated in a refrigeration cycle of operation.
Figure 7:
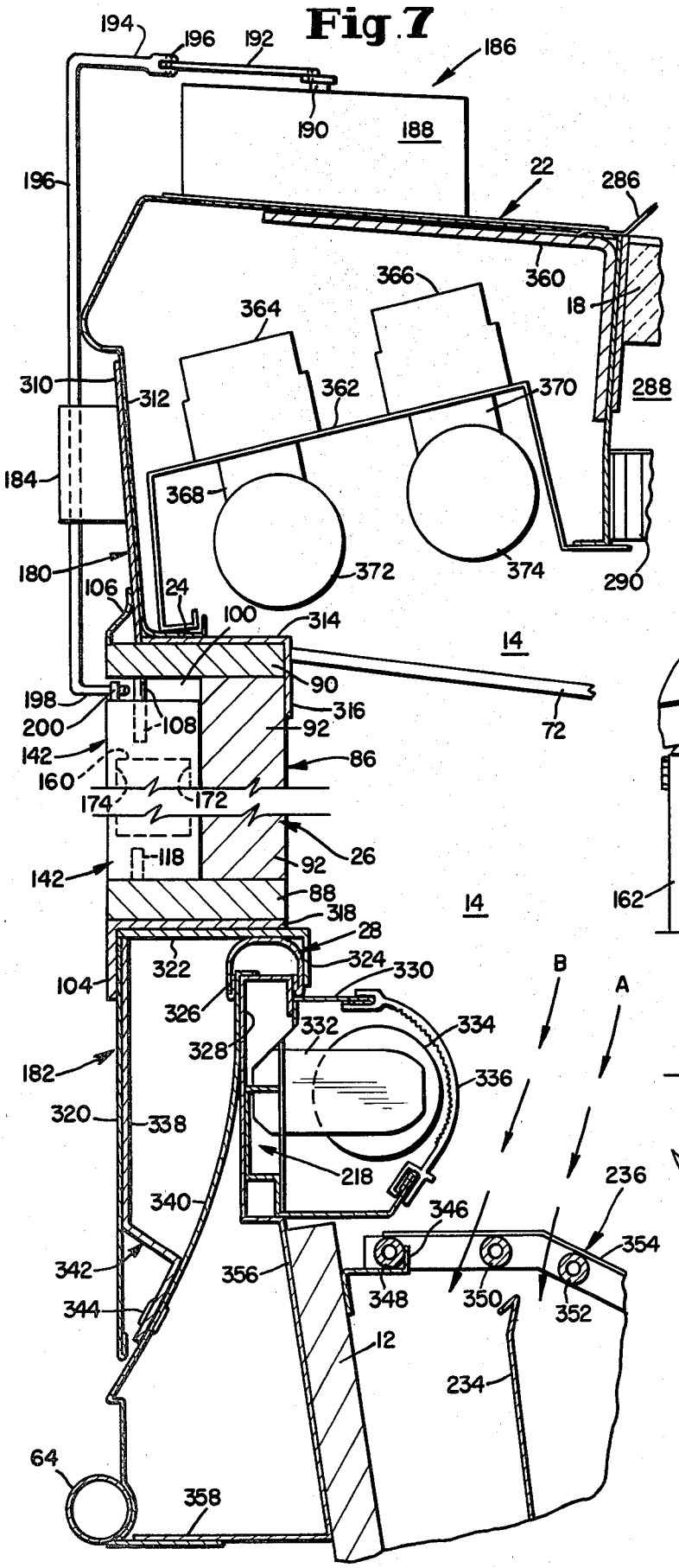
FIG. 7 is an enlarged cross-sectional view of the front portion of the refrigerated display case illustrated in FIGS. 5 and 6 wherein the door frame is shown fitted into the display case and in which the upper and lower adapter members enabling the interfitting and the door opening mechanism are shown.

Referring now to FIGS. 5-7, door frame 86 is shown retrofitting into display cabinet 10. Barrier door 142 is shown supported in door frame 86 by upper hinge pin 108 and lower hinge pin 118. Door frame mullion 92 is shown to the inside of door 142 connected to upper door frame member 90 and lower door frame member 88. Door frame 86 is fitted between upper edge portion 24 and lower edge portion 28 which define the upper and lower boundries of access opening 26 (best shown in FIG. 6). The interfitting of the door frame into display cabinet 10 is aided by provision of an upper adapter member 180 and a lower adapter member 182, shown in greater detail in FIG. 7. These adapter members are not required if the configuration of door frame 86 exactly fits into the configuration of the display cabinet 10 so that lower lip 104 and upper lip 106 can be used for fastening of the door frame into the display cabinet. A wide variety of display cabinets can be improved according to the present invention and thus upper, lower and side adapter members are provided in a variety of shapes and configurations in order to allow all such open-front refrigerated cabinets equipped with air defrost fan systems to be retrofitted with substantially similar door frames 86 by providing adapter members specially configured for the individual variations in shapes and sizes of the display cabinets. The adapters and the associated door frames function as spacer members for the barrier doors to enable interfitting adjustments. If needed other auxiliary spacers or adapter shims can also be used to interfit the doors and/or door frames.

As shown in FIGS. 5-7 upper adapter member 180 has a support bracket 184 attached to the front portion thereof which forms part of door operating mechanism 186 shown attached to the top and front portions of the display hood 22. Door operating mechanism 186 is part of the air defrost means of display cabinet 10 and is constructed of a motor and gear box 188 which has a swing arm 190 attached to its output shaft. FIG. 7 shows arm 190 pivotally linked at its opposite end to a link member 192 which is in turn pivotally linked to rod 194 by a pivot pin 196. Rod 194 has a vertical portion 196 which passes through and is rotatably supported by support bracket 184 attached to the front portion of upper adapter member 180. The bottom of vertical portion 196 is integrally connected to an operator lever 198 which contacts stud 200 secured to the top frame member 160 of door 142 (best shown in FIG. 6). When door operating mechanism 186 is activated by the air defrost means it moves from the closed position shown in FIG. 5 to the open position shown in FIG. 6 by reason of movement of operator lever 198 against stud 200. Operation of the enclosed motor in an opposite direction causes the door opening mechanism shown to return to closed position. Springs (not shown) can be included in connection with the door hinge pins to assure prompt closure of door 24. An alternate configuration is that operator lever 198 can be bifurcated so that it straddles stud 200 and moves door 142 positively in both the opening and closing directions. Another configuration for the door operating mechanism 186 is that a plurality of solenoids can operate against the doors to open the same or a single solenoid operating a multiple cam arrangement can open all doors.

Referring now to FIGS. 5-7 with respect to the internal construction of display cabinet 10 and the operation thereof, the rear portion of top wall 18 has a secondary air conduit fan housing 210 formed therein which is joined to the top edge of rear wall 212 which, in turn, extends vertically and is connected at its lower edge to bottom panel 214. An inclined bottom member 216 is connected to the front edge of bottom panel 214 and is, in turn, connected at its front-most edge with the bottom of front wall 12 which extends upwardly to support structure 218 which is affixed to the upper edge thereof. Support structure 218 defines by its uppermost edge the lower edge portion 28 of access opening 26.

Disposed about display space 20 is a primary air conduit 220 which is formed on the interior side by top panel 222 rear panel 34 and bottom display panel 224 which also forms the lower interior surfaces of display space 20. The primary air conduit 220 is formed on the exterior side by an upper divider panel 226 which is connected along the rear edge thereof to a vertical divider panel 228 which extends downwardly and parallel to rear wall 212. Both of panels 226 and 228 can be constructed of sheet metal or laminates of metal, plastic, and insulation as shown. Vertical divider panel 228 is connected along the lower edge thereof to bottom separator panel 230 which extends above and spaced away from bottom panel 214. Bottom separator panel 230 is connected at the front edge thereof as shown in FIGS. 5 and 6 to an inclined front separator panel 232 which is, in turn, joined to a substantially vertical front divider panel 234.

The top of front wall 12 provides front support for an air grille 236 which then extends from the front wall 12 in an arcuate fashion to join with interior panel member 238 which is vertically upstanding from the bottom display panel 224.

The secondary air conduit fan housing 210 is constructed of a top panel 240 connected along the top edge of rear wall 212 and along the front edge thereof to vertical top member 242 which is connected by the lower edge thereof to top wall 18. A secondary air conduit 244 is formed between top wall 18 and upper divider panel 226 at the top of the cabinet. This conduit extending vertically downward between rear divider panel 228 and rear wall 212 and then between bottom separator panel 230 and bottom panel 214 in the lower portin of the cabinet. Support feet 246 and 248 are also provided for bottom panel 214.

Primary air conduit 220 terminates at its upper end in a primary conduit outlet opening 250 in which are arranged downwardly oriented directional louvers 252. At the opposite end of primary air conduit 220 an air inlet opening 254 is provided immediately below air grille 236 and functions as an air intake for the primary air band indicated by arrows A. Outlet opening 250 and inlet opening 254 are thus arranged in aerodynamic alignment for the primary air band. The primary air band A is circulated by motor-driven primary fan 256 which is positioned in the bottom portion of primary conduit 220 and is supported therein by a baffle plate 258. Also positioned within conduit 220 are one or more evaporator coils of a refrigeration means indicated schematically as refrigeration elements 260–266. These refrigeration elements consist of sheet metal boxes in which a plurality of refrigeration evaporation coils are arranged. The sheet metal sides have openings to allow for passage of the air band(s) as illustrated in the various figures by the air flow arrows and perforations. The primary air band propelled through conduit 220 by fan 256 is maintained in a refrigerated, low temperature condition during the refrigeration cycle of operation of cabinet 10.

The upper front portion of secondary air conduit 244 formed between upper separator panel 226 and top wall 18 terminates in a secondary air conduit outlet opening 268 in which are positioned downwardly oriented directional louvers 270 which function to direct the air flow downwardly across the inside of door 142 as shown by the secondary air guard band indicated by arrows B in FIG. 5. The secondary air band enters air grille 236 at the bottom portion of door 142 and then passes into a secondary conduit air inlet opening 272 which is associated with air grille 236. The inlet and outlet openings of the secondary air conduit are also positioned in aerodynamic alignment. This secondary air inlet opening is separated from the primary conduit inlet opening 254 by the top front portion of front divider panel 234. During the refrigeration cycle of operation shown in FIG. 5 the secondary air band B is propelled in the following path: downward through the outlet opening 268 and into inlet opening 272, between front separator panel 234 and inclined bottom member 232, thereafter between separator panel 230 and bottom panel 214, then upwardly in conduit 244 between vertical divider panel 228 and rear wall 212; by means of a motor-driven secondary conduit fan 274 mounted in baffle 276 positioned within fan housing 210 at the top of case 10.

During the defrost cycle of operation shown in FIG. 6 ambient air is moved through air conduit 220 in a flow direction reversed from that shown in the refrigeration cycle in FIG. 5 in order to contact the refrigeration elements 260–266 with the warmer ambient air in order to defrost the same. Water created by this defrost action is then drained from the bottom of cabinet 10 by bottom drain 278 which is arranged at the convergence of the downwardly sloping bottom panel 214 and inclined bottom member 216. Front and rear drain tubes 280 and 282 can then be attached to the T-configured drain 278 to allow attachment to existing drainage systems within the retail store or supermarket in which cabinet 10 is positioned.

An auxiliary air fan 284 is shown supported above top wall 18 in top fan housing 286. As shown in FIG. 6 ambient air labeled "C" can be forced through auxiliary air outlet 288 in which are positioned downwardly directed louvers 290. Ambient air can be forced into the interior of cabinet 10 by fan 284 to thereby increase the inflow of ambient air into the cabinet during a defrost cycle of operation. This inflow of auxiliary air also enables additional ambient air to be drawn in through the top portion of gap G created between the barrier door 142 and the access opening 26 by means of the operation of door opening mechanism 186 as shown in FIG. 6. The drawing-in of additional ambient air through the gap G occurs by reason of fluid aspiration action. During the defrost cycle of operation illustrated in FIG. 6 the ambient air C thus drawn into cabinet 10 enters the primary air conduit 220 by means of primary conduit fan 256 when operated in a reverse direction from that shown in FIG. 5 for refrigeration cycle of operation. The ambient air thus drawn into cabinet 10 is propelled through the primary conduit 220 as shown by the dashed arrows around the periphery of display space 20 downwardly in the rear portion of the primary conduit 220 and between bottom panel 214 and bottom separator panel 230 and then up to the front of primary conduit 220. The primary air band with the entrained ambient air C is then caused to continue flowing upward and outward of cabinet 10 through the lower portion of gap G created between door 142 and access opening 26. During this defrost cycle the warmer ambient air raises the temperature of the air flowing in the ambient conduit and melts the frost and ice which have accumulated on the refrigeration elements 260–266 as above described. The secondary conduit fan 274 is not operated during this preferred defrost cycle and hence the secondary air flow is dormant. If desired heater elements of either electrical resistance or liquid line types can be positioned on the defrost upstream side of refrigeration elements 260–266 in order to increase the ambient air stream temperature. Some display cases already in use are fitted with such heaters.

The reverse flow arrows have been labeled D in conduit 220 after contact with refrigeration elements 260–266 since this is then a defrost ambient air band. If desired, the speed of the primary conduit fan 256 can be increased during this reverse flow and/or the pitch of the blades can be set to move a greater volume of air in the reverse, defrost direction than in the refrigeration cycle shown in FIG. 5 to provide for quicker defrost. A 25% to 50% greater air flow during defrost can be achieved in this manner.

The front panel trim member 68 can have extended vertical portions as provided by front cover panel 292 shown in FIGS. 5 and 6. Also shelf support brackets 294–300 can be provided as shown. Side adapter 164 of FIGS. 4 and 4A is not shown in FIGS. 5–7 due to the inclination thereof.

A compartment 302 for storage of control means and conductors can be arranged in the space between auxiliary fan housing 286 and secondary fan housing 210.

A refrigerated display cabinet 10 as shown in FIG. 1 when retrofitted with barrier doors in the manner shown in FIG. 2 can be operated in two modes for a defrost cycle. The preferred mode of defrost is that described above and shown by FIG. 6 wherein the primary air conduit fan 256 is reversed and the air flow is in the direction of the dashed arrows labeled "D". Another mode of defrost is to continue circulation of the primary air band in the direction shown by the solid arrows in FIG. 5 after the air defrost means has caused the door opening mechanism 186 to create gap G between barrier door 142 and access opening 26. Thereafter the operation of secondary conduit fan 274 is terminated and ambient air inflow is initiated through auxiliary air fan 284 in order to sweep ambient air downwardly through louvers 290 in a direction parallel and inside of the partially opened barrier door 242 in order to entrain ambient air in the primary air band labeled A and then into the primary air conduit 220 whereby the ambient air defrosts the refrigeration elements 260–266. During this mode of defrost part of the defrost air will be swept out of display space 20 through gap G.

Referring now to detailed FIG. 7, the cross-sectional view illustrated has been broken in the mid-portion in order to show the upper and lower adapter members 180 and 182 in greater detail. Upper adapter member 180 is formed with a contactor plate 310 which is secured to the front vertical wall 312 of display hood 22. A horizontal channel member 314 is attached to the lower end of plate 310 and has a downwardly shaped lip 316 on the inner side thereof for providing back support for door frame 86 which is shown by mullion 92, upper frame member 90 and lower frame member 88, all in cross-section. Downward-directed lip 316 can be used to secure the inner surface of door frame 86 to the upper adapter member 180. Also the upper door frame lip 106 can be used to connect with the front portion of plate 310 to provide additional, frontal attachment.

Lower door frame lip 104 is shown as a downwardly extending portion of L-shaped bottom channel member 318, although this construction element can be integrally extruded with bottom frame member 88 if desired. Lower adapter member 182 is shown supporting the base of door frame 86 and L-shaped channel member 318. While lower adapter member 182 can be formed in different configurations depending upon the alignment of the upper edge portion 24 with the lower edge portion 28, the specific adapter illustrated here for purpose of retrofitting cabinet 10 is of a generally inverted L-shaped member which has the long side thereof formed as a vertically extending front panel 320 which is connected to a horizontal plate 322 which is in turn connected to a downwardly directed lip 324 which engages the inner surface of a front wall trim rail 326. This trim rail is integrally attached to a light housing channel member 328 which is, in turn, integrally attached to the upper portion of front wall 12 and provides the structural components of support structure 218 shown in FIGS. 5 and 6. A light housing bracket 330 of a general C-configuration is partially enclosed by channel member 328 and is provided with fluorescent bulb holders, illustrated by holder 332, supporting a fluorescent bulb 334 and having a translucent light guard 336 arranged to interfit with the light support bracket 330 in a removable fashion. Also shown in FIG. 7 with respect to bottom adapter member 182 is a re-enforcement member 338 for contacting vertical panel 320 to enable interfastening therebetween and also for contacting front guard rail support 340 which supports the bumper rail 64. Re-enforcement member 338 is shown with a lower V-shaped end portion 342 which can be riveted to support panel 340 as shown by rivet 344 which is one of a horizontal series of such rivets. The upward panel portion of re-enforcement member 338 is then provided for interfitting with and fastening to the inverted L-shaped adapter member formed by plates 320 and 322 and 324. Thereafter the intermediary channel member or the integral bottom channel member of door frame 86 can be installed by resting the same on lower adapter member 182. The top portion of door frame 86 can be attached to upper adapter member 180 in the manner described above. Thereafter barrier doors, illustrated by door 142, can be attached to respective hinge pins illustrated by upper hinge pin 108 and lower hinge pin 118 in order to complete the blocking of the open front area of the access opening 26. This blockage eliminates contact between the outside ambient air and inside refrigerated air band or bands during a defrost cycle of operation, except for those times when the barrier doors are opened to permit movement of stored products into and out of the display merchandiser cabinet 10.

The specific upper and lower adapters described with respect to FIG. 7 are illustrative of adapter members which can be employed to allow convenient retrofitting of substantially all of the open front refrigerated display cases in which air defrost systems are provided. Thus, the present invention permits the formation of a new, improved refrigeration display cabinet 10 by installing thereon barrier doors and a door operating mechanism 186 which is part of the air defrost means in the improved refrigeration cabinet. In this manner, greater energy efficiency is achieved by limiting contact between the ambient air and the refrigerated air bands to only those times during which the display cabinet is in actual stocking or customer use, while at the same time allowing the more energy efficient air defrost systems provided within the display cabinets already in service in retail food outlets and supermarkets to continue functioning. Thus, the improved refrigerated cabinet of the present invention can be formed in situ in the retail establishment by retrofitting an available open front refrigerated display case 10 with a door frame 86, and thereafter with barrier doors, illustrated by door 142, and also fitting onto the display cabinet an air defrost means including at least one door operating mehanism for enabling creation of a gap G between the barrier door and the access opening 26. It will also be necessary to alter the control means in the display cabinet in order to operate the door operating mechanism at the appropriate time during the change from refrigeration to defrost cycle and vice versa. Also, it may be necessary to provide one or more of the air conduit fan series in the display cabinet with two directional fans to replace single directional fans. Thus, a minimum number of retrofitting steps are necessary to convert an available open front cabinet to a more energy efficient cabinet according to the present invention. This invention also incorporates the method steps by which the above retrofitting activities are carried out.

Referring again to FIG. 7, the air grille 236 is supported on one side thereof by a grille retainer bracket 346 on the inner side of front wall 12. The details of construction of grille 236 formed from tubes 348, 350 and 352 in conjunction with bracket 354 is shown overlying the upper portion of front divider panel 234. On the opposite side of front wall 12 the lower elongated portion of support bracket 328 is shown as panel 356 having a lower foot portion 358 thereon for contacting a surface of guard bumper support 340.

At the top portion of FIG. 7 display hood 22 is shown supported by a re-enforcement bracket 360 attached to the front edge of top wall 18. An upper light housing 362 is supported within display hood 22 and contains light tube fixtures 364 and 366 and lamp holders 368 and 370 for providing partial support for fluourescent tubes 372 and 374; respectively.

The inter-cooperation of vertical rotatable rod 196 of door opening mechanism 186 is shown in relation to support bracket 184. Also shown is the relationship of operator lever 198 and stud 200 located in upper door frame member 160. Door 142 is shown in closed position during a refrigeration cycle of operation and upon converting operation of the retrofitted cabinet to a defrost cycle motor and gear box 188 cause operator lever 198 to move outwardly and open door 142 in order to create a gap G of between 1 to 7 inches to allow ambient air through-flow as above described.

Figure 8:
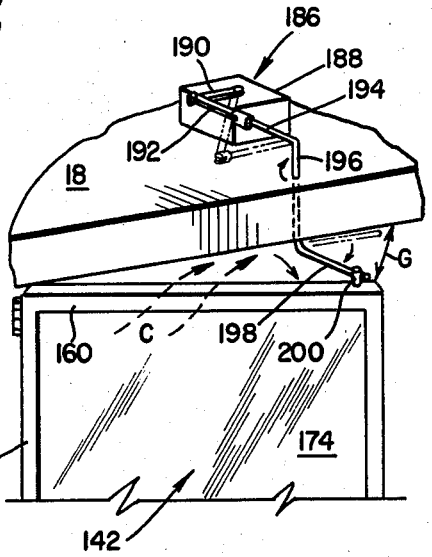
FIG. 8 is a perspective schematic view of a portion of the display case shown in FIGS. 5–7, showing a detailed view of the door opening mechanism which is part of the air defrost means.

FIG. 8 shows the closed position of the door operating mechanism 186 in dotted lines and the open position in solid lines. The linkage members 190-194 are seen in a different perspective from that shown in FIG. 7.

Figure 9:
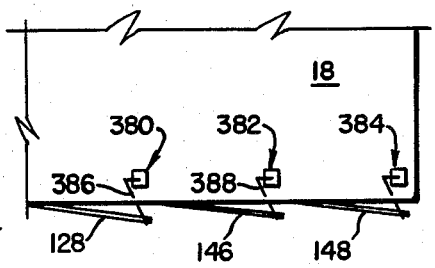
FIG. 9 is a top plan schematic view of the top right front corner portion of the display case shown in FIGS. 5–7, showing a plurality of door opening mechanisms arranged to open a like plurality of doors.

FIG. 9 shows door opening mechanisms 380, 382, and 384 connected on top wall 18. As will be appreciated from the afore-described functioning of these door opening mechanisms a single such mechanism could be arranged to operate all three doors 128, 146 and 148 shown. In the specific embodiment shown in FIGS. 1–7 as mechanisms 186, 380, 382 and 384 is an electric motor and gear box which operates a linkage-rotating rod-lever system to open door 24. Linkage systems 386, 388, and 390 are also shown schematically.

In FIGS. 1–9, at the termination of the defrost cycle the control means operates door operating mechanism 186 to allow door 142 to close and for fan 256 to then reverse its direction to re-establish the primary, refrigerated air band A shown in FIG. 5. At the same time secondary fan 274 can be engaged for operation under one of the operating alternatives as described below and the auxiliary fan 284 is stopped.

A plurality of conduit fans illustrated by primary conduit fan 256 and the secondary conduit fan 274 shown in FIGS. 5 and 6 are spaced along the length of cabinet 10 shown in FIG. 1. For example, two each of these fans are normally provided for an eight foot long case or three each of the primary and secondary fans are provided for a twelve foot case. By way of example, but not limitation, the overall height of cabinet 10 is approximately 82 inches and the width is approximately 45 inches. Such cabinets are manufactured in lengths up to 72 feet.

MODES OF OPERATION

The operation of motor driven fans 256 and 274, refrigeration elements 260–266, and door operating mechanism 186 is controlled by a control means which selectively operates these elements of cabinet 10 in a refrigeration cycle and then in an alternate defrost cycle. The control means receives signals from condition and time sensors and then switches operation of cabinet 10 between the two cycles. The operation during the defrost cycle is controlled by an air defrost means which opens the doors and controls the air moving means 256, 274 and 284. At the termination of the defrost cycle the air defrost means controls the door operating mechanisms such as 186, 380, 382 and 384 to close the doors and the fans 256 and 274 to revert to the refrigeration operation. The control means can be fabricated from conventional components, although arrangement of these components can result in several degrees of freedom in the operation of the cabinet. The control means can function during the refrigeration cycle as shown in FIG. 5 wherein air fans 256 and 274 are continuously operated and refrigerant is evaporated in the refrigeration elements 260–266 as needed in order to maintain the low temperature required by products stored in display space 20. During the refrigeration cycle the door is closed as shown in FIG. 5.

An alternate mode of operation can be provided for fan 274 during the refrigeration cycle. Door switches can be provided for operation by any of the doors so that the secondary conduit fan 274 closest to the access opening covered by that door will be activated upon the opening of the door. For this purpose a switch can be installed within cabinet 10 to be contacted when the door is closed. Another variation is that the opening and closing of the doors by customers and employees can be used as numerical input to an electronic counting circuit so that the secondary fan 274 is operated whenever a particular frequency of openings per time period is exceeded. In this manner cabinet 10 can be provided with a control means which is responsive to the shopping demand placed on the unit. This type of sensing means to provide signals for the control means can be provided for all barrier doors or only spaced and selected doors. The sensing switches can be used so that they do not sense the defrost cycle opening of the doors.

Yet another variation can be the operation of secondary fan 274 depending upon the temperature and humidity conditions in the ambient store air or in the cabinet display space.

The defrost cycle of operation for cabinet 10 can be initiated by sensing the temperature at locations spaced slightly away from the coils in refrigeration elements 260–266 so that the buildup of a predetermined thickness of frost and ice on the coils will activate the sensing element which can then initiate a defrost cycle. Another means is a timer which controls the defrost cycle occur at set intervals. Other variations are to record store ambient conditions, particularly relative humidity, and to vary the time cycle of defrost depending on such conditions. The number of openings of the cabinet doors can also be included as a control feature as above described and referenced to the operation of the secondary conduit fan 274.

The following actions occur when a defrost cycle is initiated. The refrigerant evaporation in refrigeration elements 260–266 is terminated; door operating mechanism 186 is operated to open the door as illustrated in FIG. 6; secondary conduit fan 274 is preferably stopped; primary conduit fan 256 is reversed so that the air flow pattern is as shown in FIG. 6; and auxiliary fan 284 is started, whereby ambient air enters the cabinet 10 through the auxiliary fan and the top portion of the gap G created between the barrier door 142 and the access opening 26 and then ambient air flows through primary conduit 220 in a reverse direction in order to contact the frost and ice coated coils in refrigeration elements and thereafter the resultant defrost ambient air is expelled from the bottom portion of the gap as shown. The defrost cycle can continue until a preset time is exceeded or a temperature measurement can be taken in the close proximity of the coils in refrigeration elements 260–266 so that the defrost cycle is terminated when that sensed point in these elements reaches a predetermined temperature, for example 50° F., for which purpose a sensor known as a Klixon can be employed.

The door operating mechanisms illustrated by 186 can be arranged to open the cabinet barrier doors with several degrees of freedom: (1) all doors can be opened simultaneously; (2) those doors having high customers demand use can be opened more frequently for defrost since the evaporator coils cooling the primary air band will accumulate more ice; (3) individual doors or selected sequences such as alternate doors or a majority thereof in the plural series of barrier doors can be opened for the defrost cycle; (4) the doors can be opened by predetermined gap distances such as 1 to 7 inches by way of preferred example or by a variable gap distance depending on the defrost condition and ice accumulation which can be used to define the ambient air intake requirement; and (5) the defrost cycle initiation and gap creation by the air defrost means including the door operating mechanisms can be controlled by the need for defrosting as determined by frost and ice buildup sensed on the refrigeration elements 260–266.

The operation of the air defrost refrigerated cabinet 10 described by FIGS. 1–16 can be carried out according to the various modes of operation disclosed above for the secondary air band flow, reversing of the primary air band flow direction, and opening of the barrier doors if these modes are not contrary to the sequence of operations disclosed herein for the various embodiments.

ALTERNATIVE EMBODIMENTS

Figure 10:
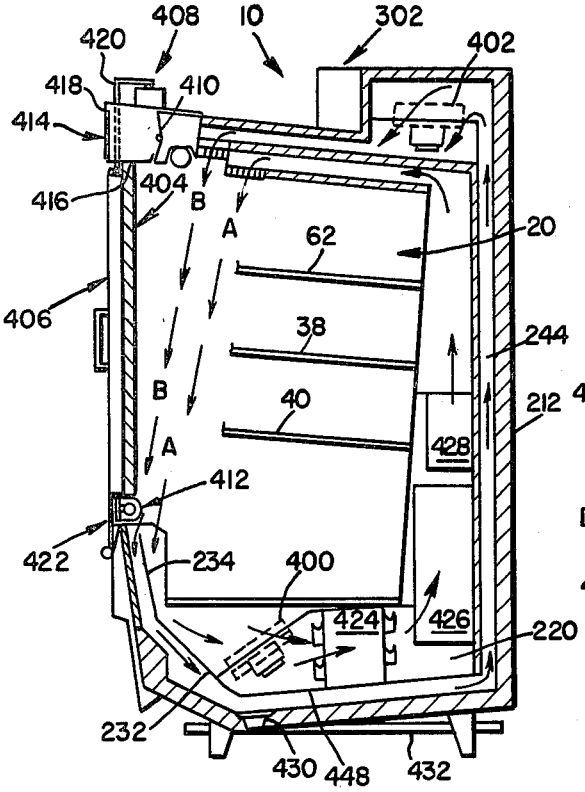
FIG. 10 is a schematic cross-sectional view of an embodiment of the present invention, shown in refrigeration cycle, in which the display case operates with two air fans.
Figure 11:
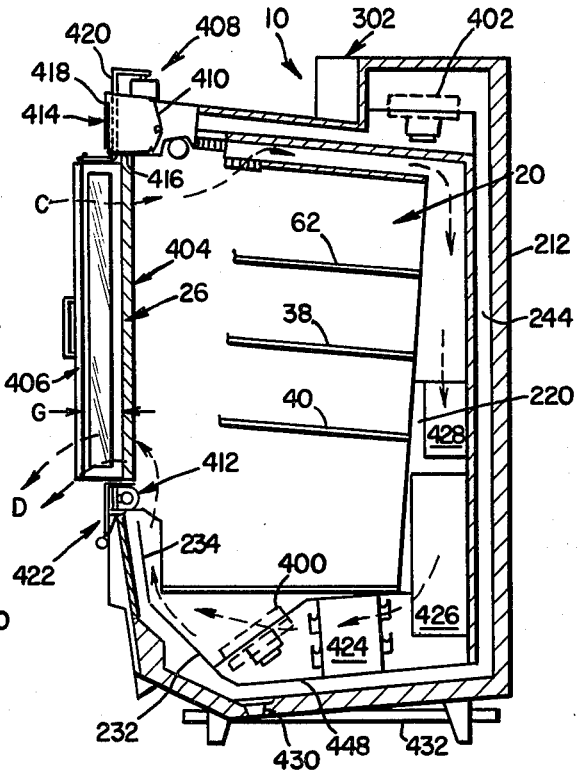
FIG. 11 is a side schematic cross-sectional view of the display cabinet illustrated in FIG. 10, shown in a defrost cycle with a gap created between the door and the access opening.

FIGS. 10 and 11 illustrate an embodiment of the present invention wherein an existing open front refrigerated cabinet 10 having only a primary conduit fan 400 and a secondary conduit fan 402 is shown retrofitted with a door frame 404 containing at least one barrier door 406 and a door operating mechanism 408. This two fan refrigerated display cabinet is constructed without the top auxiliary fan whereby the display hood 410 is further recessed from a plane passing through support structure 412 at the bottom of door frame 404. Due to this recessed configuration upper adapter member 414 can be of different form than that shown in FIGS. 5–7. A lower U-shaped bracket support 416 is provided for connecting with the front portion of display hood 410. A cover bracket 418 is then connected to the support bracket 416 and to the top portion of the display hood 410, as shown schematically. Cover bracket 418 provides support for door operating mechanism 408 which provides for rotatable rod 420 passing therethrough. The lower surface of U-shaped support bracket 416 can provide direct support for door frame 404 or an intermediate spacing member can be employed. The bottom adapter member 422 can be of the same configuration as shown in FIGS. 5–7 in this particular embodiment, although other configurations could be used if needed. The other elements of FIGS. 10 and 11 are the same as shown in FIGS. 1–6 and consequently consistent numerals have been employed.

After the open front cabinet 10 has been retrofitted with door frame 404, barrier door 406, door operating mechanism 404 and upper and lower adapter members 414 and 422 the operation during a refrigeration cycle is as shown in FIG. 10 where the primary air band A flow is shown in air conduit 220 and the secondary air band B flow is shown in conduit 244 with solid arrows. Upon initiation of a defrost cycle of operation refrigerant evaporation in refrigeration elements 424, 426 and 428 is terminated and door operating mechanism 408 is engaged to partially open door 406 in order to allow an ambient air inflow as illustrated by the dotted arrows in FIG. 11. This necessitates reversing the flow direction of the primary conduit fan 400 whereby ambient air is drawn through the primary air conduit 220 into contact with the refrigeration element 424–428 and is then forced upward and outward through gap G created between door 406 and access opening 26. Water formed by the defrosting action is drained through bottom drain 430 and drain tube 432. Upon completion of the defrost cycle door operating mechanism 408 reverses to allow door 406 to close and then the air defrost means re-establishes the operation of air fans 400 and 402 to cause air flow in the direction of the solid arrows shown in FIG. 10.

Figure 12:
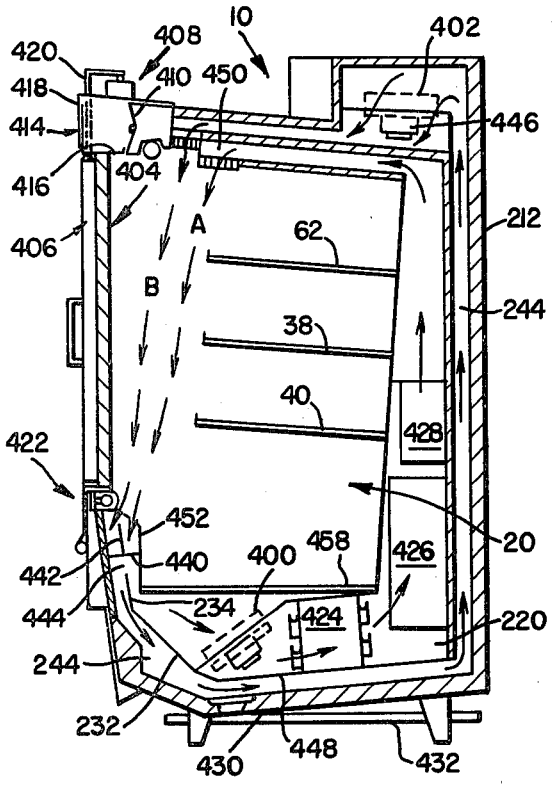
FIG. 12 is a side schematic cross-sectional view of another embodiment of the present invention, shown in the refrigeration cycle, in which an air flow guidance means is provided for deflecting air from the secondary conduit into the primary conduit in conjunction with operation during the defrost cycle.
Figure 13:
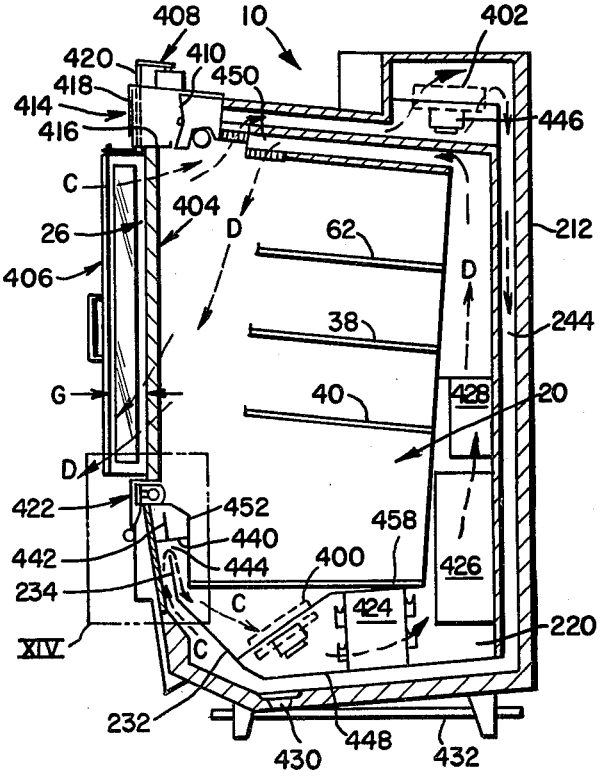
FIG. 13 shows a side schematic cross-sectional view of the cabinet illustrated in FIG. 12 when operating in a defrost cycle with a gap created between the door and the access opening to permit ambient air through-flow.
Figure 14:
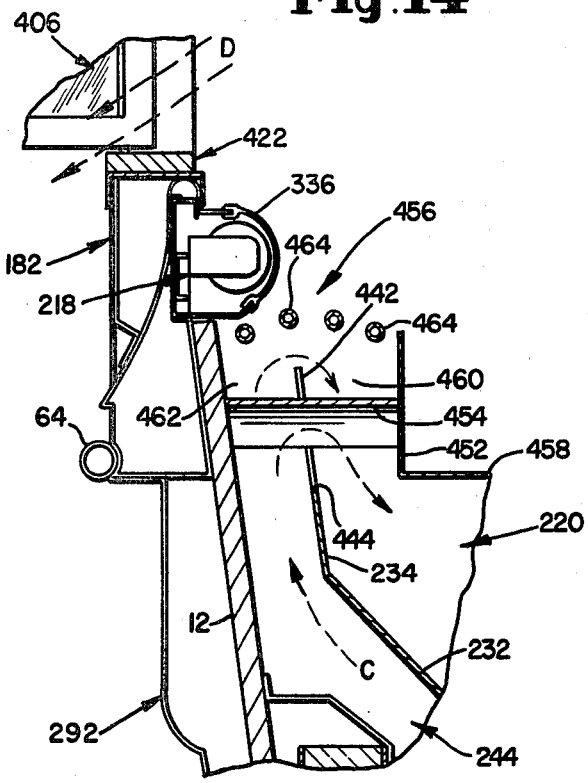
FIG. 14 is an enlarged side cross-sectional schematic view showing the air flow guidance means in block XIV in FIG. 13 in fuller detail.
Figure 15:
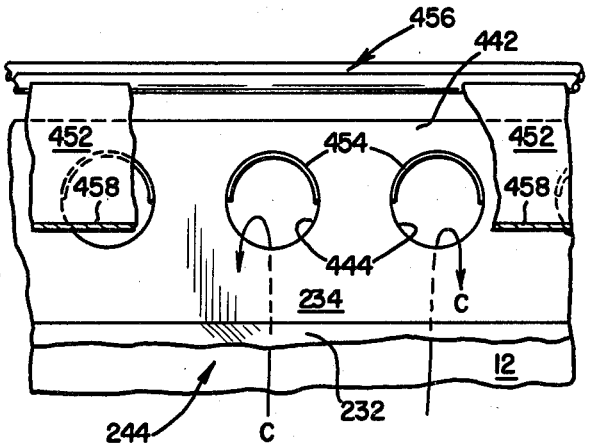
FIG. 15 is a cutaway schematic view of the inside front of a refrigeration case illustrating the air flow guidance means shown in FIG. 14.
Figure 16:
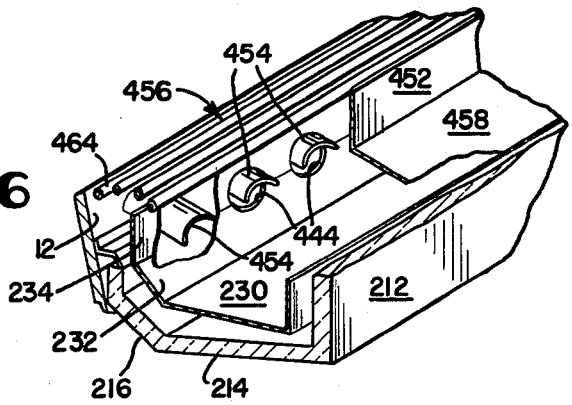
FIG. 16 is a cutaway perspective schematic view of the air flow guidance means illustrated in FIGS. 14 and 15.

FIGS. 12–16 illustrate another embodiment of the present invention wherein the secondary conduit fan can be used to assist in providing for ambient air intake into the refrigerated cabinet. In this embodiment a continuous refrigerated, primary band of air is provided in order to better protect the refrigerated state of the contents stored in display space 20. FIGS. 12 and 13 show this embodiment of the refrigerated cabinet in schematic views while FIGS. 14–16 show details of the construction. Since the cabinet structure is largely the same between the first and second embodiments consistent descriptive numerals have been employed except where different or modified elements are shown.

FIGS. 12 and 13 show a cabinet similar to that shown in FIGS. 1–9 with the exception that an air guidance means is provided by deflector plate 440 located in the front divider panel 442 which separates primary air conduit 220 from secondary conduit 244. An air opening 444 is provided to allow the passage of air from conduit 244 into conduit 220 as shown by the dashed arrow labeled C in FIGS. 13–16. In this embodiment the secondary conduit fan 402 is powered by a reversible motor 446 so that during the defrost cycle of operation shown in FIG. 13 when door 406 is opened by door operating mechanism 408 ambient air can be drawn in through the gap created between door 406 and access opening 20 as shown by dashed arrows labeled C at the top portion of FIG. 13. The secondary air band is the secondary conduit 244 then flows in a reverse direction to the direction shown during the refrigeration cycle in FIG. 12 and continues in conduit 244 under the bottom separator panel 44. This air band then encounters deflector plate 440 which diverts a portion of the air band as shown by dashed arrows C into the primary conduit 220 and the resulting mixed primary and secondary ambient air is forced by fan 400 through refrigeration elements 424–428 and then upwardly through primary conduit 220. At this point the ambient air has been somewhat reduced in temperature by contact with the ice and frost coating the coils in elements 424–428. This defrost ambient air is then propelled out of primary outlet 450 at the top of cabinet 10. This defrost air band then moves vertically downward as shown by arrows D and a portion of the air band is expelled from the bottom portion of gap G created between door 406 and access opening 26. The expelled defrost air volume is equivalent to the intake ambient air volume. The blade pitch and motor speed for fan 402 can be controlled to deliver a greater air flow during defrost to reduce the time required for de-icing. A 25% to 50% greater flow can be used for the defrost cycle. In this manner both fans function to draw in ambient air and defrost the refrigeration elements without the need for additional energy input by way of heating rods or compressed refrigerant gas loops which have been employed in the prior art.

As briefly mentioned above, the embodiment of this invention illustrated in FIGS. 12 and 13 also provides the advantage of protecting the stored content with a band of air at all times even during defrost whereas the embodiment shown in FIGS. 1–9 interrupts the counterclockwise motion of the primary air band A as shown in FIGS. 5 and 7. This continual air band provides additional protection against thawing and possible spoilage for the stored food product even though the refrigerant liquid is not evaporated in the refrigeration elements.

Deflector plate 440 does not extend across the entire length of front divider panel 234. As shown in FIGS. 14–16 the deflector plate 440 is preferably provided in the form of a plurality of cover plates 454 which have arcuate cross-sections and extend traversely on either side of front divider panel 234 substantially across each of the air conduits 220 and 244 and thus partially underlie the upper part of associated air grille 456. The cover plates 454 are secured on the front edge thereof to outer cabinet front wall 12 and on their inner edges to bottom front interior panel 452 which is an upward extension of bottom display panel 458. Interior front bottom panel 452 thus forms the front inner surface of the primary air conduit inlet opening 460 as best shown in FIG. 14. The secondary conduit inlet 462 is also shown as formed by the upper portion 442 of panel 234 and front wall 12. At this reversal position the secondary air band containing ambient air, C, is then propelled under positive pressure by secondary conduit fan 402 and by action of fan 400 through the refrigeration elements 424–428 and then upwardly through the primary air conduit 220 and hence downwardly through the primary outlet opening 450. The defrost air band is then ejected from cabinet 10 through the lower portion of gap G created by the opening of door 406 away from access opening 26. The lower adapter member 422 and the support structure 218 including light guard 336 can also be seen in this schematic view.

The construction of an air guidance means as shown in FIGS. 14–16 for deflecting at least a portion of the reversed flow secondary air band into the primary air conduit is substantially similar to that shown in U.S. Pat. No. 4,144,720 to Subera, and assigned to the same assignee as is the present application. Another embodiment of the air guidance means shown in FIGS, 8, 9 and 13 of that patent can also be employed herein.

If desired air grille 456 can be constructed in part by tubes 464 which contain circulated hot refrigerant drawn from the compressor prior to the evaporator stage. This arrangement can prevent frost buildup and blockage of the air grille.

The open-front nature of the refrigerated cabinet illustrated in FIG. 1 results in a continuous commingling of ambient air with the primary air band and, when present, the second and tertiary air bands created by the operation of the cabinet. The ambient air is both at an elevated temperature and contains a higher moisture content than the air moving in these air bands. Both the energy state of the ambient air and the moisture therein provide a heat input since the heat of fusion must be extracted from the water molecules in order to condense the same into frost which accumulates in the refrigerated cabinet on the evaporator coils and on other surfaces. This additional heat input results in the open-front type of refrigerated cabinet illustrated in FIG. 1 having a higher energy utilization than would be necessitated if the same cabinet were provided with barrier doors such as those illustrated in FIGS. 1A and 13.

A difficulty; however, is that thousands of such open-front cabinets are already out in service in retail food outlets and it is difficult to modify these cabinets in order to install barrier doors so that the energy consumption can be lowered. The difficulty arises because such cabinets must be provided with defrost mechanisms. In the cabinets equipped with the lower energy consuming air defrost systems, operation was designed for open fronts and the defrost cycle depends on flushing air from the open-front (i.e., the access opening), through the air conduits and across the evaporator coils of the refrigeration means. When doors are installed in order to lower the energy required to operate these cabinets the air defrost cycle is interrupted and thus the cabinets cannot be retrofitted with barrier doors. The problem cannot be easily solved because to provide other channels for ambient air flow which were not originally designed into the cabinets would require extensive modification of the cabinets which could likely be too expensive to be commercially considered. Entire replacement of these cabinets would of course use up the energy which went into the original fabrication of materials and components.

The present invention is thus a unique solution to overcome the above described problems and to enable open-front refrigeration cabinets to be retrofitted with barrier doors in order to lower the energy consumption required for their operation. The provision of the air defrost means of the present invention embodiment in the door opening mechanisms of the type illustrated as 186, 380, 382 and 384 and the control means which operates this mechanism and the reversible fans in the primary and/or secondary conduits, in the several embodiments, overcomes the above described problems by allowing the barrier doors to be partially opened and the defrost ambient air to be drawn in and/or ejected through the gap created between the open barrier doors and the access opening. In this manner low energy operational advantages of both barrier doors and circulating air bands can be provided for refrigerated glass door merchandiser type cabinets.

In the various embodiments of the present invention the defrost cycle encompasses the steps of causing ambient air to be drawn into the cabinet and to pass across the refrigeration means and through some portion of the primary air conduit and to be expelled from the cabinet, and of creating a gap between the barrier door and the access opening to enable ambient air throughflow. The ambient air can be made to flow in either the primary and/or the secondary air conduits. Ambient air contact with the refrigeration means is common to these embodiments.

Figure 17:
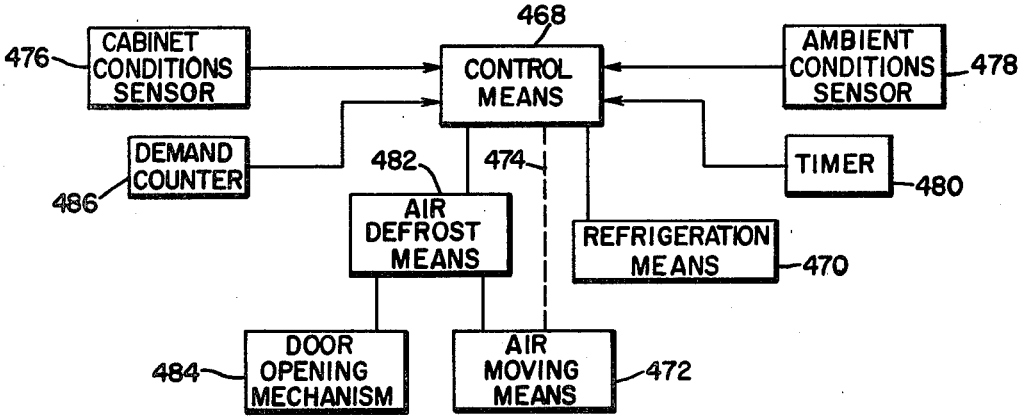
FIG. 17 is a schematic diagram of the control hierarchy involved in the operation of the refrigerated display case.

Referring to FIG. 17, a block diagram of the control hierarchy is set forth. Open front refrigerated display cabinets conventionally have control means 468 for operating refrigeration means 470 and air moving means 472, connected by dashed control line 474, in order to permit operation in a refrigeration and a defrost cycle. Devices such as cabinet condition sensors 476, ambient condition sensors 478 and timers 480 are also provided as set forth in the above MODES OF OPERATION section. When a display cabinet 10 shown in FIG. 1 is retrofitted according to the present invention an air defrost means 482 is installed for controlling the door operating mechanisms 186, 380, and 382 and 384 represented by the mechanism block 484. The air moving means 472 which controls the power to the first, second and auxiliary air fan sets is then connected through the air defrost means for control thereof during the defrost cycle. Various air fans of the air moving means 472 can also be controlled during portions of the refrigeration cycle by signals such as those generated by a demand counter circuit 486 operated by a door activated switch. The signal input is fed into the control means and used to selectively control power to the air moving means fans or sets of fans. A counting circuit can be provided within block 486 to initiate a defrost cycle when a predetermined number of door openings occur in relation to time or other conditions. The internal circuitry used within blocks 468, 482 and 486 need only be consistent with these and the other disclosed modes of operation in order to control power to the various operating devices. The control means can selectively operate the air moving means independently of the door opening mechanism 484 via line 474, for example, when the demand counter is used. This type of control during the refrigeration cycle permits the secondary fans illustrated by fan 274 to be switched on only when the barrier door is opened so that the low temperature primary band is better protected from direct contact with the ambient air. The auxiliary air fan can be operated in the same way to provide an ambient air guard band during a refrigeration cycle when the barrier door is opened. The refrigeration means 470 includes a conventional functioning compressor, condensor, receiver, expansion valve and evaporator coil sets arranged in a refrigeration circuit.

The present invention encompassing the provision of retrofitted barrier doors and air defrost means including door opening mechanisms in association with open front refrigerated display cabinets can be practiced in conjunction with all display cabinets which use ambient air movement across the access opening for defrost purposes. Thus cabinets of different air conduit arrangements can be improved through use of this invention including cabinets having common inlet chambers for both primary and secondary conduits as wherein the construction is as shown in FIGS. 5 and 6 except that the divider or separator panels 230, 232 and 234 are not provided in the bottom structure of the cabinets. In this configuration the conduits 220 and 244 are proportioned so that in reverse flow during a defrost cycle a single air fan can move a higher flow rate of ambient air through the primary conduit than is circulated through the secondary conduit. Another type of cabinet is one having only a single refrigerated air band which can be equally well retrofitted in order to gain the energy saving advantages of the present invention. These and other multi-air-band cabinets may be constructed with air passage ports other than the operable front doors as disclosed in the copending application Ser. No. 141,360 which has common inventorship and ownership with respect to the present application.

The preferred defrost air flow direction in the primary conduit for single and two air band cabinets when air band guidance means are not present is reversed from the refrigerated cycle flow. When air guidance deflectors are used the preferred flow direction is shown by FIG. 13. It is possible to operate such cabinets in the defrost cycle with the defrost air flow direction the same as in refrigeration. For this alternate flow pattern it is advisable to have an air passage port located on the top portion of the cabinet as mentioned above. With such an air passage port the defrost air can be better expelled from the cabinet to alleviate air recycling. When such an alternate defrost air flow is used in a two air band cabinet the secondary fan is not operated. In these types of display cabinets as well as those illustrated herein various defrost air flow directions can be used within the cabinets and the present application is usable with these different defrost air flow patterns.

The various modifications illustrated in FIGS. 1–17 and described above can be intercombined so that various features of the modifications can be employed to optimize operation of cabinet 10 and the energy requirements therefor.

The invention may be embodied in other specific forms without departing from the spirit or essential characteristics thereof. The present embodiments are, therefore, to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. In an open front display cabinet having refrigeration means and a display space therein; aperture means in at least one wall thereof for communicating ambient outside air with the air in said cabinet, said aperture means comprising an access opening for permitting products to be moved into and out of said display space; at least one air conduit positioned about said display space and having an outlet opening and an inlet opening at opposite ends thereof so that air leaving said air conduit outlet opening will be directed toward and received by said inlet opening; an air moving means for propelling at least one air band comprising a refrigerated air band through said air conduit during a refrigeration cycle and for propelling ambient air through said cabinet during a defrost cycle; and said refrigeration means arranged within said air conduit; the improvement comprising: a barrier door retrofitted into said display cabinet for substantially covering said access opening, air defrost means arranged in association with said display cabinet for selectively creating a gap between said barrier door and said access opening for enabling passage of ambient air into said air conduit to remove frost from said refrigeration means during a defrost cycle of operation, and said air moving means enabling propulsion of ambient air within said air conduit during a defrost cycle of operation to facilitate frost removal from said refrigeration means.

2. The improvement according to claim 1, wherein at least one spacer member is interfitted between said barrier door and said display cabinet adjacent to said access opening for enabling retrofitting of said barrier door to conserve operating energy for said display cabinet.

3. The improvement according to claim 1, wherein an upper spacer member and a lower spacer member are provided for interfitting between the upper portion of said barrier door and the lower portion of said barrier door and the upper and lower edges of said access opening for enabling retrofitting of said display cabinet with said barrier door to conserve operating energy for said display cabinet.

4. The improvement according to claim 1, wherein a door frame is interfitted between said barrier door and the edges of said access opening, and wherein said barrier door is movably supported within said door frame.

5. The improvement according to claim 4, wherein at least one adapter member is interposed between said door frame and the edges of said access opening for facilitating retrofitting of said barrier door to said display cabinet.

6. The improvement according to claim 4, wherein an upper adapter member and a lower adapter member are interposed between the upper and lower portions of said door frame and the upper and lower edges of said access opening for facilitating retrofitting of said barrier door and said door frame to said display cabinet.

7. The improvement according to claim 1, wherein said air moving means enables reversal of the flow direction of the air within said air conduit during a defrost cycle of operation to facilitate passage of ambient air into said cabinet.

8. The improvement according to claim 1, wherein said aperture means includes an air passage port in a wall of said cabinet, and wherein said air moving means enables passage of ambient air through said cabinet by moving air through said air passage port and through the gap between said barrier door and said access opening during a defrost cycle.

9. The improvement according to claim 1, wherein said aperture means includes an air passage port in a wall of said cabinet, and wherein said air moving means enables drawing of ambient air into said cabinet through said air passage port and ejects defrost ambient air through the gap between said barrier door and said access opening during a defrost cycle.

10. The improvement according to claim 1, wherein during a defrost cycle said air defrost means operates to create a gap between said barrier door and said access opening and to cause said air moving means to draw ambient air into said cabinet through a first portion of the gap and to eject the defrost ambient air through a second portion of the gap.

11. The improvement according to claim 1, wherein said aperture means includes an air passage port in a wall of said cabinet, and wherein said air moving means enables drawing of ambient air into said cabinet through the gap between said barrier door and said access opening and ejecting defrost ambient air through said air passage port during a defrost cycle.

12. The improvement according to claim 1, wherein during a defrost cycle said air defrost means selectively creates the gap between said barrier door and said access opening and permits said barrier door to substantially cover said access opening during a refrigeration cycle to thereby conserve operating energy for said display cabinet.

13. The improvement according to claim 1, wherein said air moving means comprises a first air circulation means for propelling a primary refrigerated air band within said air conduit, and a second air circulation means for selectively propelling a secondary air guard band in a second air coonduit positioned about said first air conduit, said second air circulation means enabling propulsion of said secondary air guard band in the same direction as said primary air band during a refrigeration cycle and, said second air circulation means enabling the drawing of ambient air into said secondary air band and propulsion of the ambient air through said cabinet in a reversed direction to said primary refrigerated air band and into contact with said refrigeration means during a defrost cycle.

14. The improvement according to claim 13, wherein said cabinet includes an air guidance means for deflecting at least a portion of said secondary air guard band into said primary air band during a defrost cycle.

15. The improvement according to claim 14, wherein said second air circulation means includes at least one two directional air fan for propelling said secondary air band in either direction.

16. The improvement according to claim 1, wherein a control means is provided for selectively operating said air defrost means and said refrigeration means to defrost said refrigeration means during a defrost cycle and to refrigerate said cabinet during a refrigeration cycle.

17. The improvement according to claim 16, wherein said control means contains means for reducing the refrigeration function of said refrigeration means at the beginning of a defrost cycle, for causing said air defrost means to create a gap between said barrier door and said access opening, and for drawing ambient air through said gap between said barrier door and said access opening into said cabinet and moving said ambient air into contact with said refrigeration means to defrost the same and to thereafter eject the defrost ambient air from said cabinet.

18. The improvement according to claim 1, wherein said air moving means includes an auxiliary air circulation means for increasing ambient air inflow into said display cabinet and for commingling the ambient air with said air band during a defrost cycle.

19. The improvement according to claim 1, wherein said air moving means for propelling at least one air band through said conduit comprises a first air circulation means for propelling a primary refrigerated air band during a refrigeration air cycle, and a second air circulation means for propelling a secondary air guard band in the same direction as said primary air band during a refrigeration cycle, said air defrost means selectively reversing the direction of flow of said primary air band and terminating operation of said refrigeration means and flow of said secondary air circulation means during a defrost cycle whereby ambient air is passed through said cabinet and into contact with said refrigeration means by said primary air band.

20. The improvement according to claims 13 or 19, wherein said secondary air circulation means is prevented from propelling said secondary air band during portions of the refrigeration cycle in which said barrier door is not opened.

21. The improvement according to claims 13 or 19, wherein a control means is provided for selectively operating said air defrost means and said refrigeration means to defrost said refrigeration means during a defrost cycle and to refrigerate said cabinet during a refrigeration cycle, and wherein said control means contains sensing means for detecting the opening of said barrier door and wherein said control means operates said second air circulation means for propelling said secondary air band in the same direction as said primary refrigerated air band selectively in response to the opening of said barrier door during a refrigeration cycle.

22. The improvement according to claims 13 or 19, wherein a control means is provided for selectively operating said air defrost means and said refrigeration means to defrost said refrigeration means during a defrost cycle and to refrigerate said cabinet during a refrigeration cycle, and wherein said control means includes means for sensing the refrigeration condition within said display space and means for selectively operating said air moving means during a refrigeration cycle to propel said secondary air band in the same direction as said primary refrigeration air band depending upon the refrigeration conditions sensed.

23. The improvement according to claim 1, wherein said air defrost means comprises at least one door operating mechanism retrofitted into association with a portion of said display cabinet adjacent to said access opening for enabling the selective creation of a gap between said barrier door and said access opening during a defrost cycle of operation.

24. The improvement according to claim 1, wherein said air moving means for propelling at least one air band comprises a first air circulation means for selectively propelling a primary refrigerated air band within said air conduit contained in said cabinet, and a second air circulation means for selectively propelling a secondary air guard band within a secondary air conduit contained in said cabinet in the same direction as said primary air band during a refrigeration cycle; said air defrost means during a defrost cycle of operation terminating operation of said second air circulation means and causing said primary air band to draw ambient air from outside said cabinet and into contact with said refrigeration means to defrost the same.

25. The improvement according to claim 24, wherein during a defrost cycle of operation said first air circulation means is caused to reverse the flow of said primary air band from the direction of flow during a refrigeration cycle of operation and to discharge defrost ambient air through a portion of said aperture means other than said access opening.

26. The improvement according to claim 24, wherein during a defrost cycle of operation defrost ambient air is discharged from said cabinet through the gap between said barrier door and said access opening.

27. The improvement according to claim 24, wherein said air moving means includes an auxiliary air circulation means for increasing ambient air inflow to said display cabinet and for commingling the ambient air with said primary air band during a defrost cycle of operation in which the direction of air flow is maintained the same as in a refrigeration cycle, and wherein the defrost ambient air is discharged from said cabinet through the gap between said barrier door and said access opening.

28. The improvement according to claim 1, wherein said air conduit consists of a primary air conduit arranged inside said cabinet about said display space for containing a primary refrigerated air band during a refrigeration cycle of operation, and a secondary air conduit arranged within said cabinet adjacent to a substantial portion of said primary air conduit, and said secondary air conduit connected at an inlet end thereof to said primary air conduit, said primary and secondary conduits being separated along the lengths thereof from said secondary conduit inlet and to the outlet ends thereof, and said cabinet including a common conduit inlet chamber for said primary air conduit and said secondary air conduit.

29. The improvement according to claim 1, wherein a plurality of barrier doors are attached to said display cabinet for substantially covering said access opening, and wherein said air defrost means selectively creates a gap between at least alternate doors in the series of said barrier doors and said access opening during a defrost cycle of operation.

30. The improvement according to claim 29, wherein said air defrost means creates a gap between substantially all of said barrier doors and said access opening.

31. The improvement according to claim 1, wherein said barrier door contains therein a transparent material viewing port.

32. The improvement according to claim 29, wherein said air defrost means comprises a series of door operating mechanisms arranged for individually and selectively creating a gap between a majority of said barrier doors and said access opening during a defrost cycle of operation.

33. The improvement according to claim 29, wherein said air defrost means comprises a door operating mechanism for selectively creating a gap between at least a majority of the doors and said access opening.

34. In an open front display cabinet having refrigeration means and a display space therein accessible through at least one access opening, at least one air band circulated within the said cabinet, air moving means for circulating said air bands within said cabinet, at least one of said air bands cooled by contact with said refrigeration means; the improvement comprising: a barrier door fitted to said display cabinet for substantially covering said access opening, means providing a plurality of air bands for circulation within said cabinet for selectively maintaining a flow pattern across said access opening during a refrigeration cycle, air defrost means for selectively creating a gap between said barrier door and said access opening for enabling passage of ambient air at least into said air band in contact with said refrigeration means to remove frost therefrom during a defrost cycle of operation, and said air moving means propelling the flow of the ambient air within said cabinet during a defrost cycle of operation.

35. The improvement according to claim 34, wherein said air moving means enables reversal of the direction of flow of at least one of said air bands during a defrost cycle of operation to facilitate passage of ambient air into said cabinet.

36. In an open front display cabinet having refrigeration means and a display space therein accessible through at least one access opening, at least one air band circulated within said cabinet, air moving means for circulating said air bands within said cabinet, at least one of said air bands cooled by contact with said refrigeration means; the improvement comprising: a barrier door fitted to said display cabinet for substantially covering said access opening, at least one spacer member interfitted between said barrier door and the edges of said access opening for enabling retrofitting of said barrier door into said display cabinet, means providing a plurality of air bands for circulation within said cabinet for selectively maintaining a flow pattern across said access opening during a refrigeration cycle, air defrost means for selectively creating a gap between said barrier door and said access opening for enabling passage of ambient air at least into said air band in contact with said refrigeration means to remove frost therefrom during a defrost cycle of operation, and said air moving means propelling the flow of ambient air within said cabinet during a defrost cycle of operation.

37. In an open front display cabinet having refrigeration means and a display space therein accessible through at least one access opening, at least one air band circulated within said cabinet, air moving means for circulating said air bands within said cabinet, at least one of said air bands cooled by contact with said refrigeration means; the improvement comprising: a barrier door fitted to said display cabinet for substantially covering said access opening, an upper spacer member and a lower spacer member interfitted between the upper portion of said barrier door and the lower portion of said barrier door and the upper edge of said access opening and the lower edge thereof for enabling retrofitting of said barrier door into said access opening, means providing a plurality of air bands for circulation within said cabinet for selectively maintaining a flow pattern across said access opening during a refrigeration cycle, air defrost means for selectively creating a gap between said barrier door and said access opening for enabling passage of ambient air at least into said air band in contact with said refrigeration means to remove frost therefrom during a defrost cycle of operation, and said air moving means propelling the flow of ambient air within said cabinet during a defrost cycle of operation.

38. In an open front display cabinet having refrigeration means and a display space therein accessible through at least one access opening, at least one air band circulated within said cabinet, air moving means for circulating said air bands within said cabinet, at least one of said air bands cooled by contact with said refrigeration means; the improvement comprising: a barrier door fitted to said display cabinet for substantially covering said access opening, means providing a plurality of air bands for circulation within said cabinet for selectively maintaining a flow pattern across said access opening during a refrigeration cycle, air defrost means for selectively creating a gap between said barrier door and said access opening for enabling passage of ambient air at least into said air band in contact with said refrigeration means to remove frost therefrom during a defrost cycle of operation, said air moving means propelling the flow of the ambient air within said cabinet during a defrost cycle of operation and comprising a first air circulation means for propelling a primary refrigerated air band and a second air circulation means for selectively propelling a secondary air guard band in the same direction as said primary air band during a refrigeration cycle and for drawing ambient air into said secondary air band and then propelling the ambient air through said cabinet in a reverse direction to said refrigerated air band and into contact with said refrigeration means during a defrost cycle.

39. The improvement according to claim 38, wherein said cabinet includes an air guidance means for deflecting at least a portion of said secondary air guard band into said primary air band during a defrost cycle.

40. In an open front display cabinet having refrigeration means and a display space therein accessible through at least one access opening, at least one air band circulated within said cabinet, air moving for circulating said air bands within said cabinet, at least one of said air bands cooled by contact with said refrigeration means; the improvement comprising: a barrier door fitted to said display cabinet for substantially covering said access opening, a door frame interfitted between the edges of said access opening and said barrier door, said door movably supported by said door frame, means providing a plurality of air bands for circulation within said cabinet for selectively maintaining a flow pattern across said access opening during a refrigeration cycle, air defrost means for selectively creating a gap between said barrier door and said access opening for enabling passage of ambient air at least into said air band in contact with said refrigeration means to remove frost therefrom during a defrost cycle of operation, and said air moving means propelling the flow of the ambient air within said cabinet during a defrost cycle of operation.

41. The improvement according to claim 40, wherein at least one adapter member is provided between said door frame and at least one of the edges of said access opening for enabling retrofitting of said barrier door and said door frame into said open front display cabinet to substantially cover the access opening thereof.

42. The improvement according to claim 41, wherein a plurality of adapter members are provided for enabling retrofitting of said door frame and said barrier door into said open front display cabinet.

43. The improvement according to claim 34, wherein said air defrost means comprises at least one door operating mechanism retrofitted into association with a portion of said display cabinet adjacent to said access opening for enabling the selective creation of a gap between said barrier door and said access opening during a defrost cycle of operation.

44. The improvement according to claim 34, wherein lighting means are included in said cabinet for illuminating said display space.

45. The improvement according to claim 34, wherein said barrier door contains therein a transparent material viewing port.

46. In an open front display cabinet having refrigeration means and a display space therein accessible through at least one access opening, at least one air band circulated within said cabinet, air moving means for circulating said air bands within said cabinet, at least one of said air bands cooled by contact with said refrigeration means, the improvement comprising: a barrier door fitted to said display cabinet for substantially covering said access opening, means providing a plurality of air bands for circulation within said cabinet for selectively maintaining a flow pattern across said access opening during a refrigeration cycle, air defrost means for selectively creating a gap between said barrier door and said access opening for enabling passage of ambient air at least into said air band in contact with said refrigeration means to remove frost therefrom during a defrost cycle of operation, and said air moving means propelling the flow of the ambient air within said cabinet during a defrost cycle of operation and including an auxiliary air circulation means for increasing ambient air inflow into said display cabinet and for comingling the ambient air with at least said air band cooled by contact with said refrigeration means during a defrost cycle.

47. In an open front display cabinet having refrigeration means and a display space therein accessible through at least one access opening, at least one air band circulated within said cabinet, air moving means for circulating said air bands within said cabinet, at least one of said air bands cooled by contact with said refrigeration means; the improvement comprising: a barrier door fitted to said display cabinet for substantially covering said access opening, means providing a plurality of air bands for circulation within said cabinet for selectively maintaining a flow pattern across said access opening during a refrigeration cycle, air defrost means for selectively creating a gap of predetermined distance between said barrier door and said access opening for enabling passage of ambient air at least into said air band in contact with said refrigeration means to remove frost therefrom during a defrost cycle of operation, and said air moving means propelling the flow of the ambient air within said cabinet during a defrost cycle of operation.

48. In an open front display cabinet having refrigeration means and a display space therein accessible through at least one access opening, a plurality of air bands circulated within said cabinet for selectively maintaining a flow pattern across said access opening during a refrigeration cycle, air moving means for circulating said air bands within said cabinet, at least one of said air bands cooled by contact with said cabinet, at least one of said air bands cooled by contact with said refrigeration means; the improvement comprising: a barrier door fitted to said display cabinet for substantially covering said access opening, air defrost means for selectively creating a gap between said barrier door and said access opening for enabling passage of ambient air at least into said air band in contact with said refrigeration means to remove frost therefrom during a defrost cycle of operation, said air defrost means selectively creating a gap of variable distance between said barrier door and said access opening depending upon the amount of frost accumulation on said refrigeration means, and aid air moving means propelling the flow of the ambient air within said cabinet during a defrost cycle of operation.

49. In an open front display cabinet having refrigeration means and a display space therein accessible through at least one access opening, at least one air band circulated within said cabinet, air moving means for circulating said air bands within said cabinet, at least one of said air bands cooled by contact with said refrigeration means; the improvement comprising: a barrier door fitted to said display cabinet for substantially covering said access opening, means providing a plurality of air bands for circulation within said cabinet for selectively maintaining a flow pattern across said access opening during a refrigeration cycle, air defrost means for selectively creating a gap of approximately one to seven inches between said barrier door and said access opening for enabling passage of ambient air at least into said air band in contact with said refrigeration means to remove frost therefrom during a defrost cycle of operation, and said air moving means propelling the flow of the ambient air within said cabinet during a defrost cycle of operation.

50. In association with an open front display cabinet having refrigeration means and a display space therein; aperture means in at least one wall thereof for communicating ambient outside air with the air in said cabinet, said aperture means comprising: an access opening for permitting products to be moved into and out of said display space; at least one air conduit extending about said display space and having an outlet opening and an inlet opening at opposite ends thereof so that air leaving said air conduit outlet opening will be directed toward and received by said inlet opening; an air moving means for propelling at least one air band comprising a refrigerated air band through said air conduit during a refrigeration cycle and for propelling ambient air through said cabinet during a defrost cycle; and a refrigeration means arranged within said air conduit; the improvement comprising: a door frame retrofitted into close spaced relationship to said access opening, at least one barrier door supported in said door frame for substantially covering the open front area of said access opening, air defrost means for selectively creating a gap between said barrier door and said access opening for enabling passage of ambient air into said air conduit to remove frost from said refrigeration means during a defrost cycle of operation, and said air moving means enabling propulsion of ambient air within said air conduit during a defrost cycle of operation to facilitate frost removal from said refrigeration means.

51. The improvement according to claim 50, wherein at least one adapter member is interposed between said door frame and the edge of said access space to allow said door frame to be retrofitted to differently shaped open front areas of said access opening.

52. The improvement according to claim 50, wherein upper and lower adapter members are provided for positioning between the upper portion of said door frame and the lower portion of said door frame and the upper and lower edges of said access opening to facilitate retrofitting of said door frame to differently shaped open front areas of said access opening.

53. The improvement according to claim 50, wherein side adapter members are also provided for enabling interfitting between the side edges of said door frame and the side edges of said access opening.

54. The improvement according to claim 50, wherein a plurality of barrier doors are supported by said door frame for substantially covering said access opening, and wherein said air defrost means selectively creates a gap between at least alternate doors in the series of said barrier doors and said access opening during a defrost cycle of operation.

55. The improvement according to claim 54, wherein said air defrost means creates a gap between substantially all of said barrier doors and said access opening.

56. The improvement according to claim 54, wherein said barrier doors contain therein transparent material viewing ports.

57. The improvement according to claim 54, wherein said air defrost means comprises a series of door operating mechanisms arranged for individually and selectively creating a gap between a majority of said barrier doors and said access opening during a defrost cycle of operation.

58. The improvement according to claim 54, wherein said air defrost means comprises a door operating mechanism for selectively creating a gap between at least alternate doors and said access opening during a defrost cycle of operation.

59. The improvement according to claim 54, wherein said air defrost means comprises at least one door operating mechanism retrofitted into association with a portion of said display cabinet adjacent to said access opening for enabling the selective creation of a gap between at least a major of said barrier doors and said access opening during a defrost cycle of operation.

60. An open front display cabinet having refrigeration means and a display space therein accessible through at least one access opening, at least one air band circulated within said cabinet, at least one of said air bands cooled by contact with said refrigeration means; the improvement comprising: a barrier door fitted to said display cabinet for substantially covering said access opening, means providing a plurality of air bands within said cabinet for selectively maintaining a flow pattern across said access opening during a refrigeration cycle, and air defrost means for selectively creating a gap between said barrier door and said access opening for enabling passage of ambient air at least into said air band in contact with said refrigeration means to remove frost therefrom during a defrost cycle of operation.

61. an open front display cabinet having refrigeration means and a display space therein accessible through at least one access opening, at least one air band circulated within said cabinet, at least one of said air bands cooled by contact with said refrigeration means; the improvement comprising: a barrier door fitted to said display cabinet for substantially covering said access opening, a door frame interfitted between said barrier door and said access opening for supporting said barrier door in close fitting relationship to said access opening, means providing a plurality of air bands within said cabinet for selectively maintaining a flow pattern across said access opening during a refrigeration cycle, and air defrost means for selectively creating a gap between said barrier door and said access opening for enabling passage of ambient air at least into said air band in contact with said refrigeration means to remove frost therefrom during a defrost cycle of operation.

62. An open front display cabinet having refrigeration means and a display space therein accessible through at least one access opening, a plurality of air bands circulated within said cabinet for selectively maintaining a flow pattern across said access opening during a refrigeration cycle, at least one of said air bands cooled by contact with said refrigeration means; the improvement comprising: a barrier door fitted to said display cabinet for substantially covering said access opening, a door frame interfitted between said barrier door and said access opening for movably supporting said barrier door, and air defrost means for selectively creating a gap between said barrier door and said access opening for enabling passage of ambient air at least into said air band in contact with said refrigeration means to remove frost therefrom during a defrost cycle of operation.

63. An open front display cabinet having refrigeration means and a display space therein accessible through at least one access opening, a plurality of air bands circulated within said cabinet for selectively maintaining a flow pattern across said access opening during a refrigeration cycle, at least one of said air bands cooled by contact with said refrigeration means; the improvement comprising: a barrier door fitted to said display cabinet for substantially covering said access opening, air defrost means for selectively creating a gap between said barrier door and said access opening for enabling passage of ambient air at least into said air band in contact with said refrigeration means to remove frost therefrom during a defrost cycle of operation, and a heater element positioned adjacent to said refrigeration means for increasing the temperature of the ambient air prior to contact with said refrigeration means.

64. The improvement according to claim 61, wherein at least one adapter member is interfitted between said door frame and the edges of said display cabinet adjacent to said access opening to facilitate retrofitting of said door frame to said display cabinet.

65. The improvement according to claim 61, wherein upper and lower adapter members are provided for interfitting said door frame into the access opening of said display cabinet to facilitate retrofitting of said door frame to said display cabinet.

66. The improvement according to claim 61, wherein at least one adapter member is provided for interfitting between a side of side door frame and a side edge of said display cabinet adjacent to said access opening.

67. The improvement according to claim 61, wherein a plurality of barrier doors are supported by said door frame for substantially covering said access opening.

68. The improvement according to claim 67, wherein said barrier doors contain therein transparent material viewing ports.

69. An open front display cabinet having refrigeration means and a display space therein accessible through at least one access opening, at least one air band circulated within said cabinet, at least one of said air bands cooled by contact with said refrigeration means; the improvement comprising: a barrier door fitted to said display cabinet for substantially covering said access opening, means providing a plurality of air bands within said cabinet for selectively maintaining a flow pattern across said access opening during a refrigeration cycle, and air defrost means for selectively creating a gap between said barrier door and said access opening for enabling passage of ambient air at least into said air band in contact with said refrigeration means to remove frost therefrom during a defrost cycle of operation, said air defrost means comprising at least one door operating mechanism retrofitted into association with a portion of said display cabinet adjacent to said access opening.

70. A method of improving the energy efficiency of a refrigerated display cabinet having an air defrost system, a display space therein, aperture means in at least one wall thereof for communicating ambient outside air with the air in the cabinet, the aperture means comprising an access opening for permitting products to be moved into and out of the display space, at least one air band circulated within the cabinet for selectively maintaining a flow pattern inside of the cabinet across the access opening and cooled by contact with a refrigeration means during a refrigeration cycle of operation and, a control means for selectively operating the air band and the refrigeration means to refrigerate the cabinet during a refrigeration cycle and to defrost the refrigeration means during a defrost cycle; the method comprising the steps of: installing covering means for the aperture means including at least one barrier door for substantially covering the access opening, fitting an air defrost means comprising at least one door operating mechanism into association with the display cabinet for enabling creation of a gap between the barrier door and the access opening; adjusting the control means of the display cabinet to enable operation during a refrigeration cycle including, circulating the air band through the display cabinet to form an air curtain across the access opening along a path inside of the barrier door, and propelling the air band through the refrigeration means; adjusting the control means to enable operation during a defrost cycle including, reducing operation of the refrigeration means, causing ambient air to be drawn into the cabinet and pass through the refrigeration means, ejecting defrost ambient air from the cabinet, and creating a gap between the barrier door and the access opening by operating the air defrost means to enable ambient air through-flow; whereby the barrier door increases the energy efficiency by decreasing contact of the ambient air with the air band during a refrigeration cycle in which the barrier door is not open, and wherein ambient air is drawn across the refrigeration means during a defrost cycle of operation to defrost the same.

71. A method according to claim 70, including the additional steps of interfitting a door frame between the barrier door and the access opening, and supporting the barrier door movably in the door frame for permitting products to be moved into and out of the display space.

72. A method according to claim 71, including the additional step of adjusting the installation of the door frame into the portion of the display cabinet defining the access opening by interfitting between the door frame and the edges of the access opening at least one adapter member.

73. A method according to claim 72, wherein said adjusting of the door frame is carried out by positioning an upper adapter member between the upper portion of the door frame and the upper edge of the display cabinet adjacent the access opening thereof.

74. A method according to claim 72, wherein said adjusting of the door frame is carried out by positioning a lower adapter member between the lower portion of the door frame and the lower edge of the display cabinet adjacent to the access opening thereof.

75. A method according to claim 72, wherein said adjusting of the door frame is carried out by positioning at least one side adapter member between a side portion of the door frame and the side edge of the display cabinet adjacent the access opening thereof.

76. A method according to claim 71, including the additional step of installing a plurality of doors within the door frame.

77. A method according to claim 70, including the additional step of causing the control means to reverse the flow of air band during a defrost cycle to facilitate ambient air inflow into the display cabinet.

78. A method according to claim 70, wherein the air band cooled by contact with the refrigeration means is a primary air band, and wherein a secondary air band is provided for circulation within the display space about the primary air band; and including the additional steps of: during a defrost cycle of operation, terminating the circulation of the secondary air band, reversing the flow direction of the primary air band to facilitate the drawing in of ambient air by the reverse flow primary air band.

79. A method according to claim 70, wherein the air band in contact with a refrigeration means is a primary air band, and wherein a secondary air band is provided for circulation about the primary air band and an air guidance means is provided within the display cabinet for deflecting at least a portion of the flow of the secondary air band into the primary air band when the secondary air band is operated in a reverse flow direction from the flow of the primary air band; and including the additional steps of: during a defrost cycle, reversing the flow of the secondary air band, causing ambient air to be drawn into the secondary air band at least in part through the gap created between the barrier door and the access opening, and causing ambient air to be circulated with the reverse flow secondary air band and then deflected by the guidance means into the primary air band and then into contact with the refrigeration means to defrost the same.

80. A method according to claim 79, wherein the quantity of air flowing in the secondary air band during a defrost cycle is 25% to 50% greater than the flow during a refrigeration cycle of operation.

81. A method according to claim 70, wherein the air band in contact with a refrigeration means is a primary air band, and wherein a secondary air band is provided for circulating about the primary air band, and wherein an auxiliary air moving means is provided within the display cabinet; and including the additional steps of: during a defrost cycle of operation, terminating circulation of the secondary air band, reversing the flow direction of the primary air band to facilitate the drawing in of ambient air into the reverse flow primary air band and then into contact with the refrigeration means to defrost the same, and propelling ambient air into the display cabinet by operation of the auxiliary air moving means.

82. A method according to claim 70, wherein the air band in contact with the refrigeration means is a primary air band and wherein a secondary air band is provided for circulation about the primary air band, and wherein an auxiliary air moving means is provided within the display cabinet for increasing ambient air inflow during a defrost cycle; and including the additional steps of: during a defrost cycle, reversing the flow direction of the secondary air band, causing ambient air to be drawn into the reverse flow secondary air band, and thereafter deflecting a portion of the secondary air band containing the ambient air into the primary air band and then into contact with the refrigeration means to defrost the same.

83. A method of improving the energy efficiency of a refrigerated display cabinet having an air defrost system and a display space therein, aperture means in at least one wall thereof for communicating ambient outside air with the air in the cabinet, the aperture means comprising an access opening for permitting products to be moved into and out of the display space, at least one air band circulated within the cabinet for selectively maintaining a flow pattern inside of the cabinet across the access opening and the air band cooled by contact with a refrigeration means, and a control means for selectively operating the air defrost means and the refrigeration means to defrost the refrigeration means during a defrost cycle and to refrigerate the cabinet during a refrigeration cycle; the method comprising the steps of: fitting a door frame into the display cabinet adjacent to the edges of the cabinet defining the access opening, installing at least one barrier door for substantially covering the access opening, fitting an air defrost means comprising at least one door operating mechanism into association with the display cabinet for enabling creation of a gap between the barrier door and the access opening, adjusting the control means for operation during a refrigeration cycle including, circulating the air band through the display cabinet to form an air cutrain across the access opening along a path inside of the barrier door, and propelling the air band through the refrigeration means, and adjusting the control means for operation during a defrost cycle of operation including, reducing operation of the refrigeration means, causing ambient air to be drawn into the cabinet and pass through the refrigeration means, ejecting defrost ambient air from the cabinet, and creating a gap between the barrier door and the access opening by functioning of the air defrost means to enable ambient air throughflow; whereby the barrier door increases the energy efficiency by decreasing contact of the ambient air with the air band during a refrigeration cycle and whereby ambient air is drawn through the refrigeration means to defrost the same by communicating ambient air with the refrigeration means during a defrost cycle of operation.

84. A method according to claim 83, including in association with said fitting of a door frame into the display cabinet the additional step of: interposing between the door frame and the display cabinet at least one adapter member.

85. A method according to claim 84, wherein said interposing of the adapter member is carried out between the upper portion of the door frame and the upper edge of the display cabinet defining the access opening thereof.

86. A method according to claim 84, wherein said interposing of the adapter member is carried out between the lower portion of the door frame and the lower edge of the display cabinet defining the access opening thereof.

87. A method according to claim 84, wherein said interposing of the adapter member is carried out between the side portion of the lower frame and the side edge of the display cabinet defining the access opening thereof.

88. A method according to claim 83, wherein a plurality of doors are installed into the door frame.

89. A method of improving the energy efficiency of a refrigerated display cabinet having a display space therein accessible through at least one access opening, a plurality of air bands circulated within the cabinet for selectively maintaining a flow pattern inside of the cabinet across the access opening, and at least one of the air bands cooled by contact with the refrigeration means; the method comprising the steps of: installing at least one barrier door for substantially covering the access opening, fitting an air defrost means comprising at least one door operating mechanism into association with the display cabinet for enabling creation of a gap between the barrier door and the access opening, selectively operating the display cabinet in a refrigeration cycle of operation and in a defrost cycle of operation; during a refrigeration cycle, circulating the air bands through the display cabinet so as to form an air curtain across the access opening along a path inside of the barrier door, and propelling at least one of the air bands through the refrigeration means; during a defrost cycle of operation, reducing operation of the refrigeration means, causing ambient air to be drawn into the cabinet and pass through the refrigeration means, ejecting defrost ambient air from the cabinet, and creating a gap between the barrier door and the access opening by operation of the air defrost means to enable ambient air through-flow, whereby the barrier door increases the energy efficiency by decreasing contact of the ambient air with the air bands during a refrigeration cycle, and whereby ambient air is drawn through the refrigeration means to defrost the same by communicating ambient air with at least the air band in contact with the refrigeration means during a defrost cycle of operation.

90. A method according to claim 89, including the additional steps of interfitting a door frame between the barrier door and the access opening, and supporting the barrier door movably in the door frame for permitting products to be moved into and out of the display space.

91. A method according to claim 90, including the additional step of adjusting the interfit of the door frame into the portion of the display cabinet defining the access opening by interposing between the door frame and the edges of the access opening at least one adapter member.

92. A method according to claim 91, wherein said adjusting of the door frame interfit is carried out by positioning at least one upper adapter member between the upper portion of the door frame and the upper edge of the display cabinet adjacent the access opening thereof.

93. A method according to claim 91, wherein said adjusting of the door frame interfit is carried out by positioning at least one lower adapter member between the lower portion of the door frame and the lower edge of the display cabinet adjacent to the access opening thereof.

94. A method according to claim 91, wherein said adjusting of the door frame interfit is carried out by positioning at least one side adapter member between a side portion of the door frame and the side edge of the display cabinet adjacent the access opening thereof.

95. A method according to claim 90, including the additional step of installing a plurality of doors within the door frame.

96. A method according to claim 89, wherein a control means is provided in the display cabinet for selectively operating the air defrost means and the refrigeration means to defrost the same during a defrost cycle and to refrigerate the cabinet during a refrigeration cycle; and including the additional steps of: adjusting the control means for operation during a refrigeration cycle of operation including, circulating at least one of the air bands through the display cabinet to form an air curtain across the access opening along a path inside of the barrier door, and propelling the air band through the refrigeration means; and adjusting the control means for functioning during a defrost cycle of operation including, reducing operation of the refrigeration means, causing ambient air to be drawn into the cabinet and pass through the refrigeration means, ejecting defrost ambient air from the cabinet, and creating a gap between the barrier door and the access opening by functioning of the air defrost means to enable ambient air through-flow.

97. A method according to claim 90, wherein a plurality of doors are installed into the door frame, and wherein the doors have therein transparent material viewing ports.

98. A display cabinet according claim 48, wherein the gap distance between said barrier door and said access opening is approximately one to seven inches.

* * * * *

UNITED STATES PATENT AND TRADEMARK OFFICE

CERTIFICATE OF CORRECTION

PATENT NO. : 4,369,631

DATED : January 25, 1983

INVENTOR(S) : Fayez F. Ibrahim

It is certified that error appears in the above-identified patent and that said Letters Patent is hereby corrected as shown below:

In the heading, inventor "Abraham" should be --Ibrahim--.

In the title,"MERCHANDIZER" should be --MERCHANDISER--.

Column 1, line 1, "MERCHANDIZER" should be --MERCHANDISER--;

, line 10, delete "June" and insert --March--;

, line 29, "interfer" should be --interfere--.

Column 8, line 67, "portin" should be --portion--.

Column 12, line 68, ";" should be --,--;

, line 31, "in situ" should be --in situ--.

Column 17, line 41, "Figs," should be --Figs.--;

, line 66, ";" should be --,--.

Column 18, line 62, "380, and 382" should be --380, 382--.

Column 21, line 53, "coonduit" should be --conduit--.

Column 25, lines 1 and 2, "retrofitting" should be divided --retro-fitting--.

, line 48, "moving for" should be --moving means for--.

Column 26, line 41, "comingling" should be --commingling--.

UNITED STATES PATENT AND TRADEMARK OFFICE

CERTIFICATE OF CORRECTION

PATENT NO. : 4,369,631

DATED : January 25, 1983

INVENTOR(S) : Ibrahim

It is certified that error appears in the above-identified patent and that said Letters Patent is hereby corrected as shown below:

Column 27, line 16, "aid" should be --said--.

Column 28, line 44, "major" should be --majority--.

Column 29, line 57, "side door" should be --said door--.

Column 30, line 26, "and," should be --, and--.

Column 14, line 33, "occur" should be deleted.

Signed and Sealed this

*Eighth* Day of *May 1984*

[SEAL]

*Attest:*

GERALD J. MOSSINGHOFF

*Attesting Officer*

*Commissioner of Patents and Trademarks*